US009033270B2

(12) United States Patent
Vantrease

(10) Patent No.: US 9,033,270 B2
(45) Date of Patent: May 19, 2015

(54) APPARATUS FOR CIRCULATING COMMINUTED MATERIALS

(71) Applicant: Irwin Research and Development, Inc., Yakima, WA (US)

(72) Inventor: Dale L. Vantrease, Naches, WA (US)

(73) Assignee: Irwin Research and Development, Inc., Yakima, WA (US)

( * ) Notice: Subject to any disclaimer, the term of this patent is extended or adjusted under 35 U.S.C. 154(b) by 23 days.

(21) Appl. No.: 13/736,015

(22) Filed: Jan. 7, 2013

(65) Prior Publication Data

US 2013/0175379 A1 Jul. 11, 2013

Related U.S. Application Data

(60) Provisional application No. 61/584,149, filed on Jan. 6, 2012.

(51) Int. Cl.

| | |
|---|---|
| ***B02C 4/40*** | (2006.01) |
| ***B02C 18/14*** | (2006.01) |
| ***B02C 18/16*** | (2006.01) |

(52) U.S. Cl.
CPC ..... *B02C 4/40* (2013.01); *B02C 18/142* (2013.01); *B02C 18/16* (2013.01)

(58) Field of Classification Search
CPC ..... B02C 4/40
USPC ..... 241/166, 167, 236
See application file for complete search history.

(56) References Cited

U.S. PATENT DOCUMENTS 6,969,017 B2 * 11/2005 Irwin ..... 241/60

* cited by examiner

*Primary Examiner* — Mark Rosenbaum
(74) *Attorney, Agent, or Firm* — Wells St. John P.S.

(57) ABSTRACT

An improved scraper plate assembly is provided on a comminuting device having compliant rounded edges, sloped walls, and reduced height for placement along recycle flow paths within a comminuting apparatus when circulating subdivided waste material from between a pair of scissor rolls for further delivery to a scissor roll for further movement and subdividing of the subdivided waste material. A comminuting apparatus is also provided.

20 Claims, 22 Drawing Sheets

APPARATUS FOR CIRCULATING COMMINUTED MATERIALS

CROSS REFERENCE TO RELATED APPLICATION

This application claims priority to U.S. Provisional Patent Application Ser. No. 61/584,149 which was filed on Jan. 6, 2012, the entirety of which is incorporated by reference herein.

TECHNICAL FIELD

The presently disclosed subject matter pertains to apparatus for subdividing waste materials. More particularly, the presently disclosed subject matter relates to apparatus for comminuting solid waste materials, such as plastic sheet material.

BACKGROUND OF THE INVENTION

Techniques are known for severing waste material, particularly plastic sheet material, into small, rather uniform particles or pieces that can be readily recycled by passing the material between a pair of scissor rolls. Improvements are needed in how material is circulated through and/or around a pair of scissor rolls.

SUMMARY OF THE INVENTION

An improved scraper plate assembly is provided on a comminuting device having compliant rounded edges, sloped walls, and reduced height for placement along recycle flow paths within a comminuting apparatus when circulating subdivided waste material from between a pair of scissor rolls for further delivery to a scissor roll for further movement and subdividing of the subdivided waste material.

According to one aspect, an apparatus is provided for circulating comminuted materials. The apparatus includes a frame, a pair of scissor rolls, and a scraper plate. The pair of scissor rolls is carried for counter-rotation by the frame. The scraper plate is inter-nested with one of the scissor rolls and has a rounded outermost end, a pair of opposed and sloped side walls, and a profile height extending beyond an outer surface of the scissor roll a distance less than a diameter of the scissor roll.

According to another aspect, a comminuting apparatus is provided having a frame, a pair of overlapping scissor rolls, and a scraper plate. The frame has an enclosure with an entrance for receiving sold waste material, an entrance manifold, and a recycle manifold. The pair of overlapping scissor rolls is carried for counter-rotation by the frame. The scraper plate is carried by the frame and inter-nested with one of the scissor rolls and has a rounded outermost end, a pair of opposed and sloped side walls, and a profile outermost dimension extending in a radially outward direction from an outermost surface of the one scissor roll through a center axis of the one scissor roll less than a diameter of the scissor roll. The scraper plate communicates with at least one of the recirculation manifold and the recycle manifold to enable subdivided scrap material to cascade over the outermost end and into one of the recirculation manifold and the recycle manifold.

BRIEF DESCRIPTION OF THE DRAWINGS

Preferred embodiments of the disclosure are described below with reference to the following accompanying drawings.

DETAILED DESCRIPTION OF THE PREFERRED EMBODIMENTS

This disclosure is submitted in furtherance of the constitutional purposes of the U.S. Patent Laws "to promote the progress of science and useful arts" (Article 1, Section 8).

Figure 1:
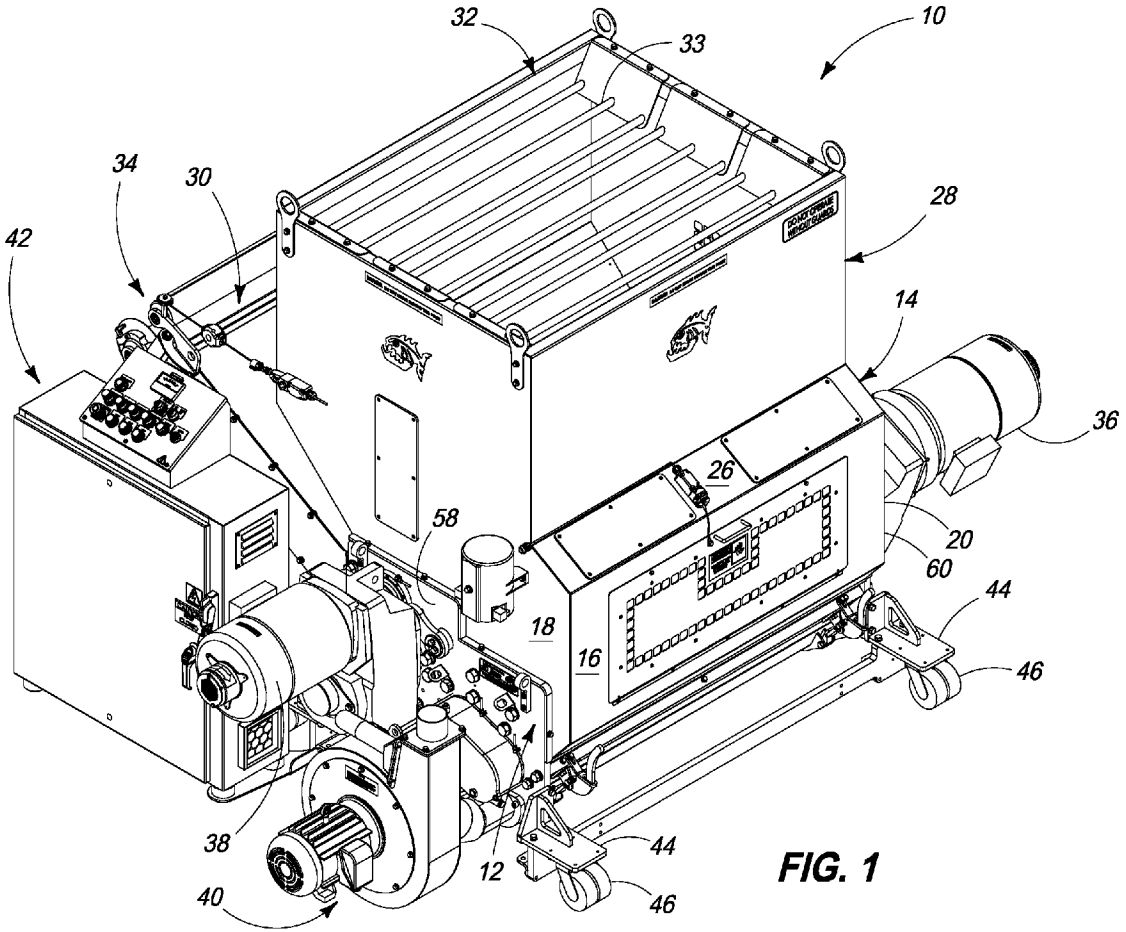
FIG. 1 is a perspective view from above of one comminuting apparatus with a scraper plate assembly having an improved geometry for enhancing the circulation of severed waste material around scissor rolls.
Figure 9:
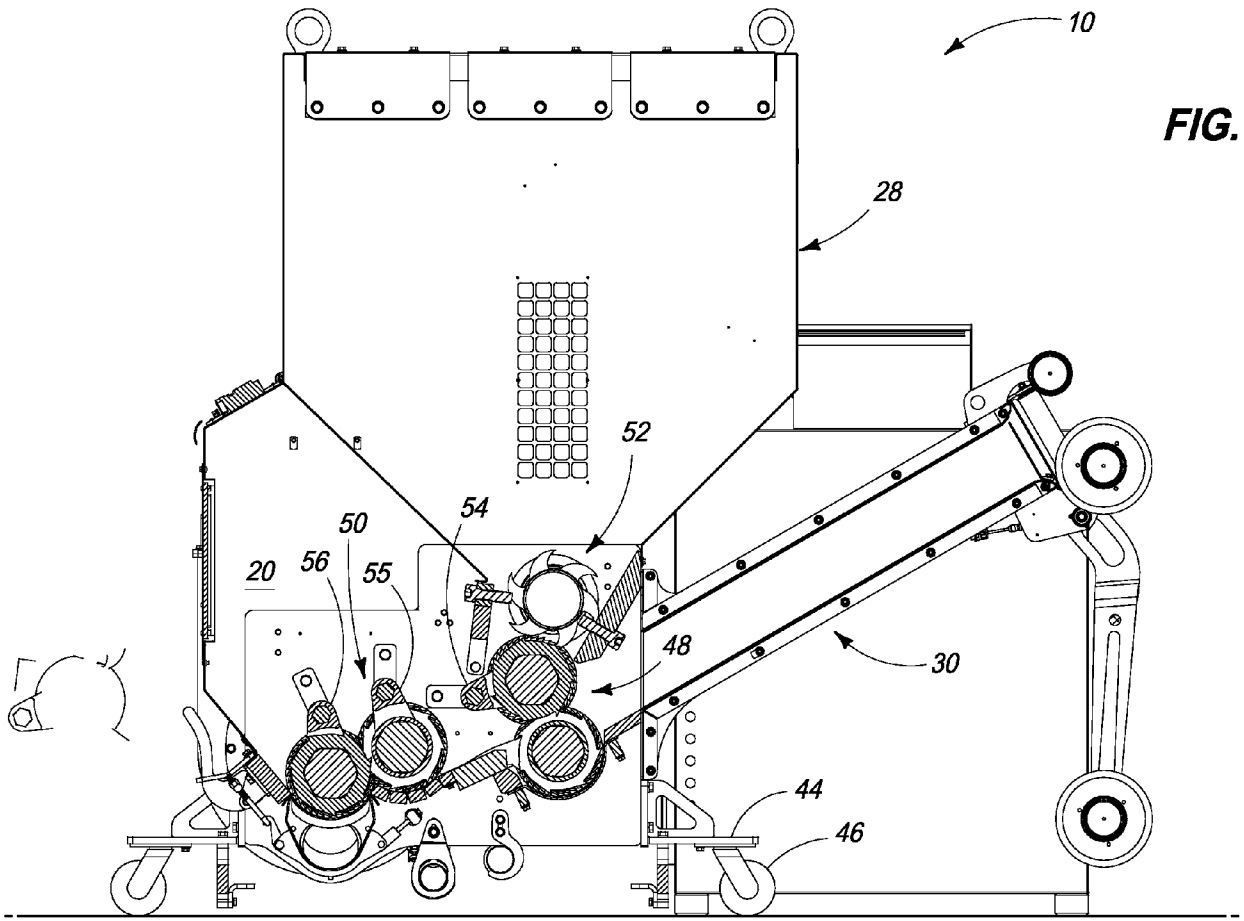
FIG. 9 is a vertical sectional view taken along line 9-9 of FIG. 8.
Figure 10:
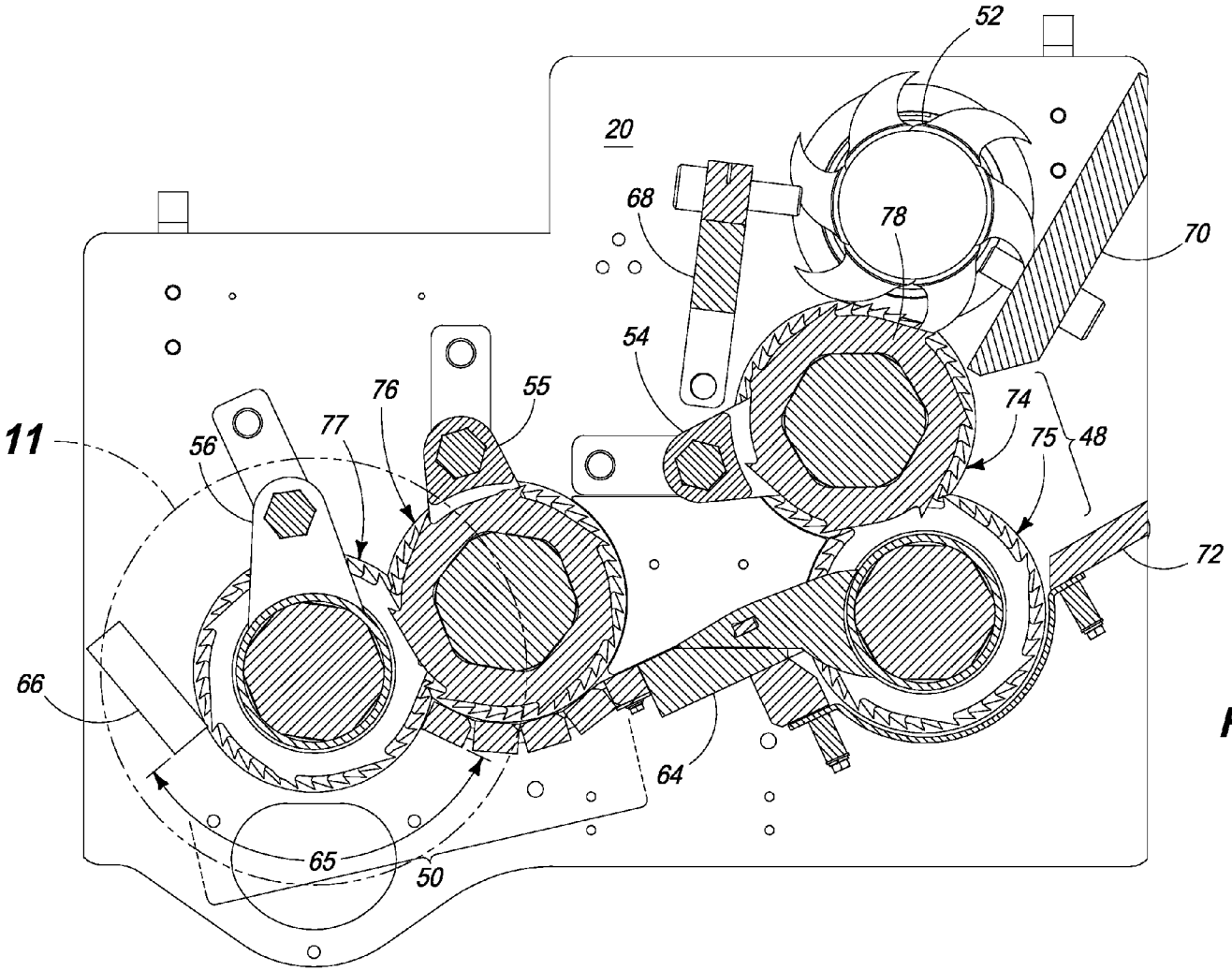
FIG. 10 is an enlarged partial and sectional view of the pairs of scissor rolls within the comminuting apparatus and corresponding with the sectional view taken in FIG. 9.

FIG. 1 is a perspective view from above of one comminuting apparatus 10 with a scraper plate assembly 54-56 (see FIG. 2) having an improved geometry for enhancing the circulation of severed waste material around scissor rolls 74-77 (see FIG. 10). Comminuting apparatus 10 includes a frame 12 that includes an enclosure 14. Enclosure 14 includes a front wall 16, side walls 18 and 20, back wall 22 (see FIG. 3), bottom wall 24 (see FIGS. 5 and 8) and top wall 26 (see FIG. 7). Side plates (or side frames) 58 and 60 form a portion of each side wall 18 and 20 (see FIG. 1). Frame 12 may be supported on legs 44 that each have individual pairs of wheels 46 at each end (see FIGS. 1-9).

Comminuting apparatus 10 includes a top material receiving duct 28 with a material entrance 32 and a side material receiving duct 30 with a material receiving entrance 34. Entrance 32 includes three guards 33, each comprising three parallel steel rods extending across the entrance to prevent user access during use. A control cabinet 42 houses a controller and associated components for controlling operation of comminuting apparatus 10. A first scissor roll drive motor assembly 36 drives a pair 48 of scissor rolls 74, 75 (see FIG. 10) and a second scissor roll drive motor assembly 38 drives a pair 50 of scissor rolls 76, 77 (see FIG. 10). Each drive motor assembly 36 and 38 comprises a variable speed AC drive motor, a speed reduction gearbox, and a flux vector AC drive (housed in cabinet 42).

Figure 2:
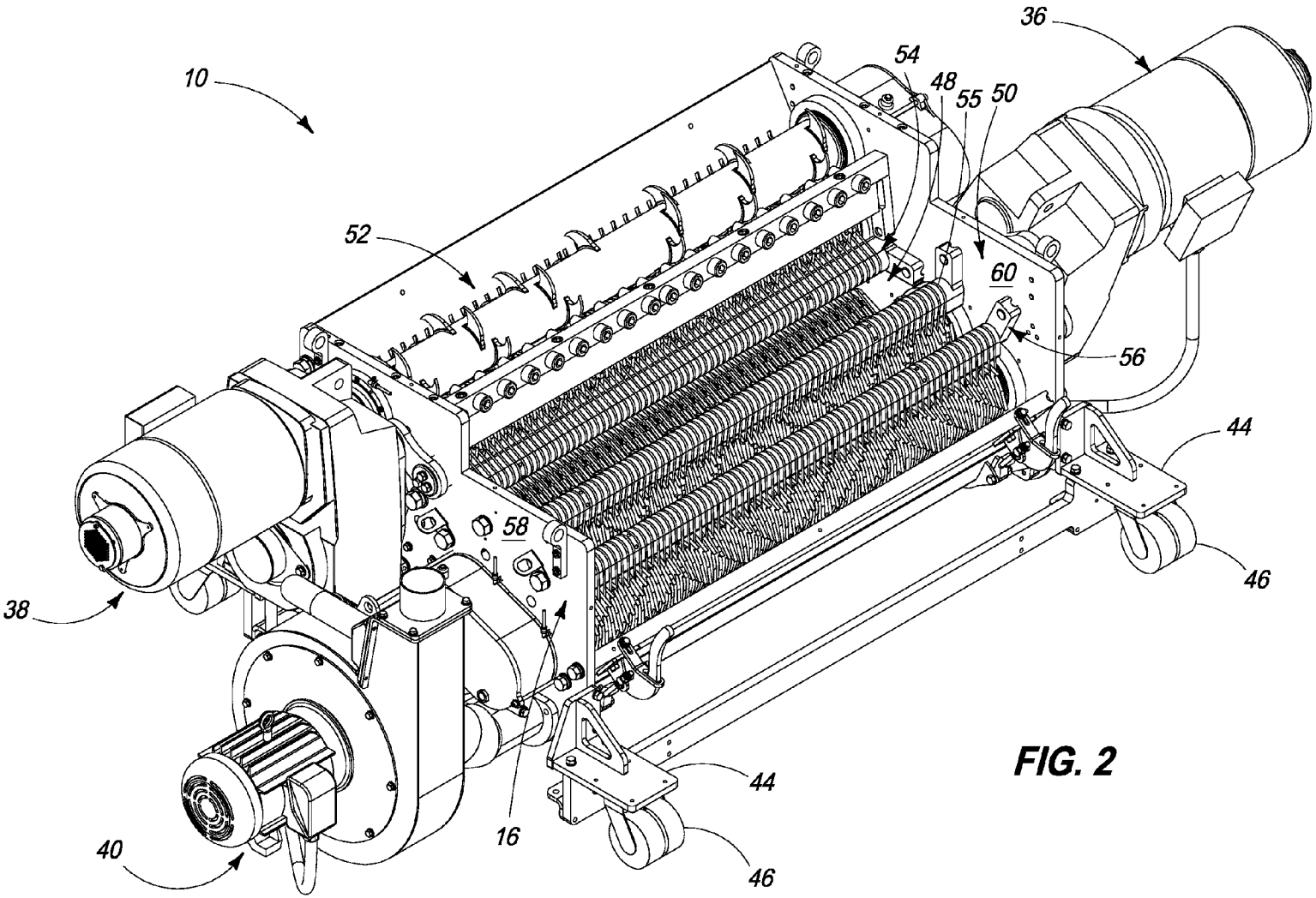
FIG. 2 is a perspective view from above of the comminuting apparatus of FIG. 1 with portions removed to facilitate depiction of internal components including two pairs of scissor rolls, each having improved scraper plate assemblies.
Figure 21:
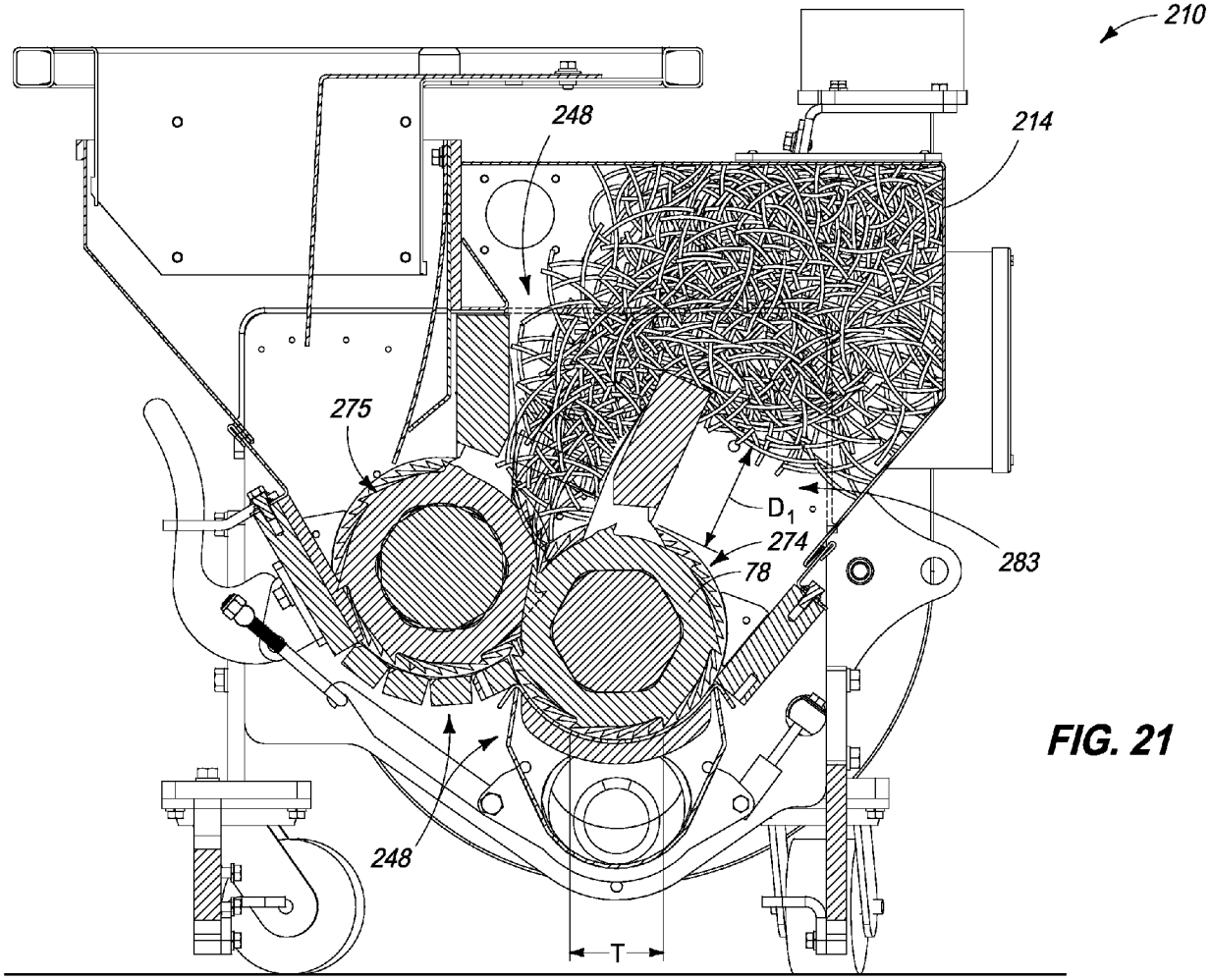
FIG. 21 is a vertical sectional view of the alternatively constructed comminuting apparatus of FIG. 20 showing a clog of subdivided waste material within the enclosure.

FIG. 2 is a perspective view from above of the comminuting apparatus 10 of FIG. 1 with portions removed to facilitate depiction of internal components including two pairs 48 and 50 of scissor rolls 74-75 and 76-77 (see FIG. 10), each having improved scraper plate assemblies 54-56. Scraper plate assemblies 54-56 each have a rounded outer, or top end, sloped side walls, and a lowered profile height that promotes movement of entangled masses of subdivided waste material over each scraper plate assembly and back to a respective scissor roll for cutting and further delivery of further subdividing between a respective pair of scissor rolls. Hence, a clogging or compaction condition of waste material depicted in FIG. 21 is reduced or eliminated. The provision of ends that are rounded, smoothed, radius, or otherwise unlikely to discourage passage of a mass of subdivided waste material from moving past a scraper plate provides a significant benefit for many types of plastic materials being recycled in a comminuting apparatus.

Also shown in FIG. 2, an in-feed roll 52 is driven in co-rotation with pair 48 of scissor rolls 74, 75 (see FIG. 10) by drive motor assembly 38 to draw scrap material into material entrance 32 (see FIG. 1). Scraper plate assemblies 54-56 are affixed at opposed ends to side plates 58 and 60, respectively.

Figure 3:
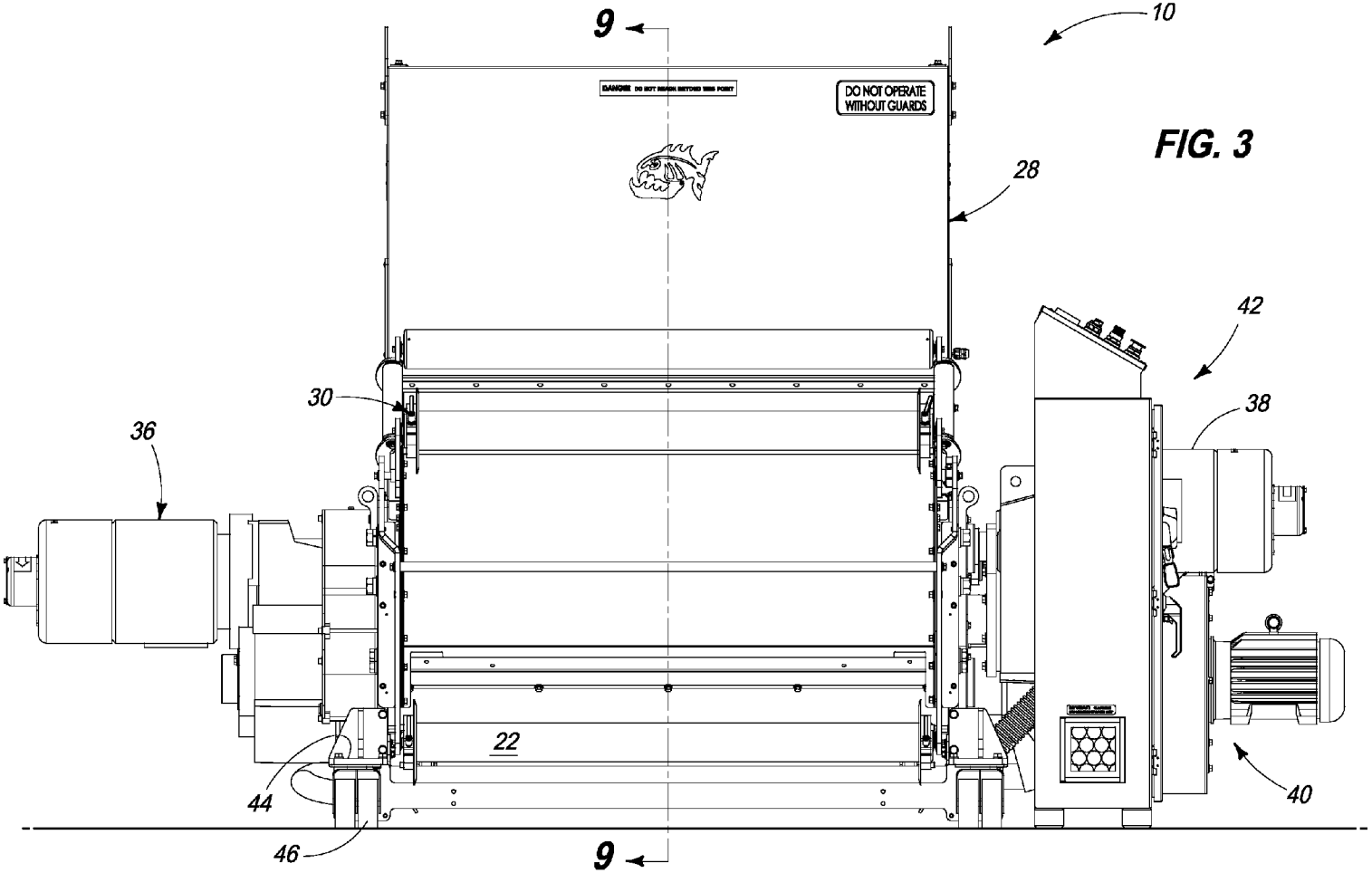
FIG. 3 is back view of the comminuting apparatus of FIG. 1.
Figure 4:
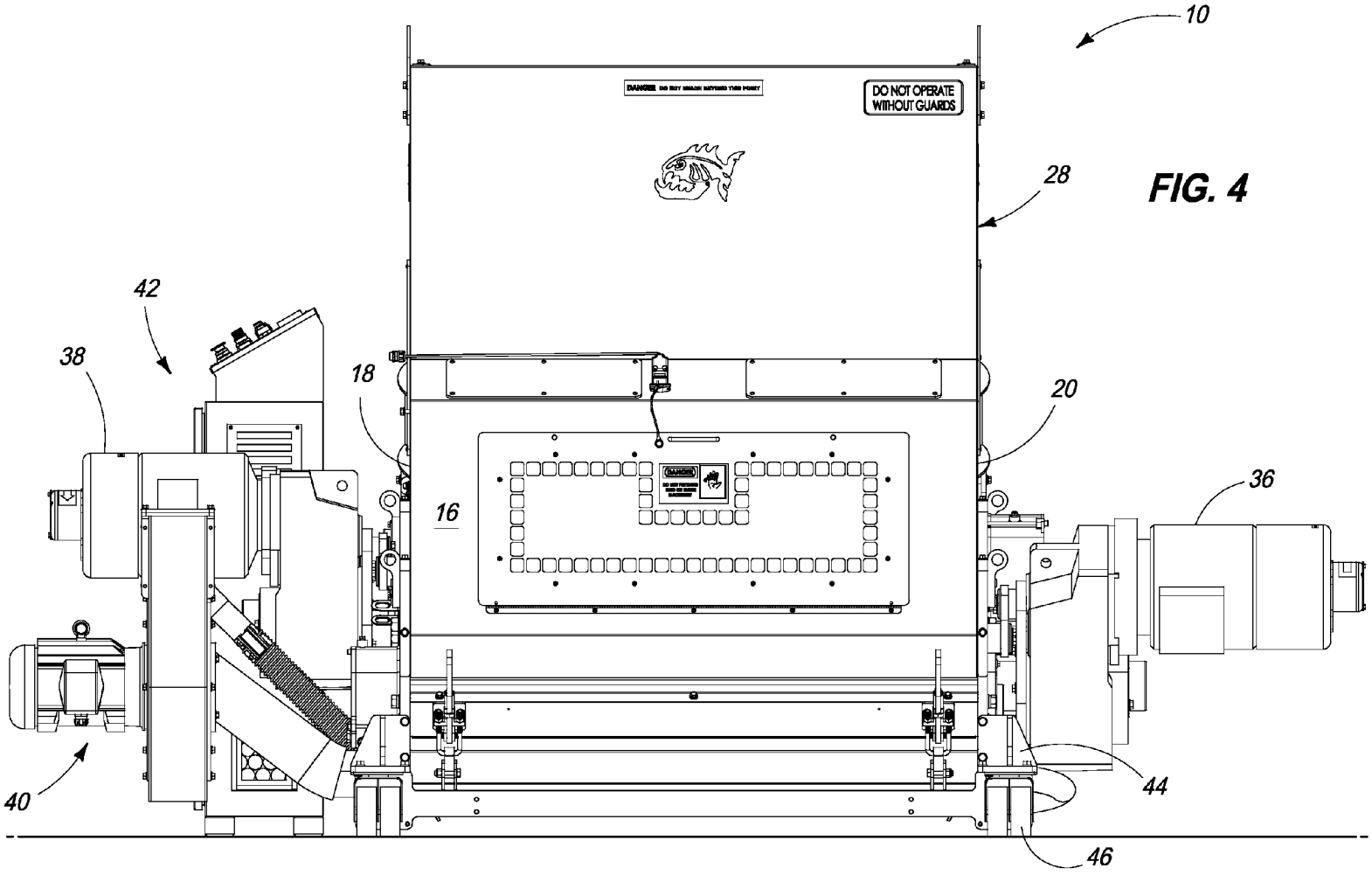
FIG. 4 is a front view of the comminuting apparatus of FIGS. 1 and 3.
Figure 5:
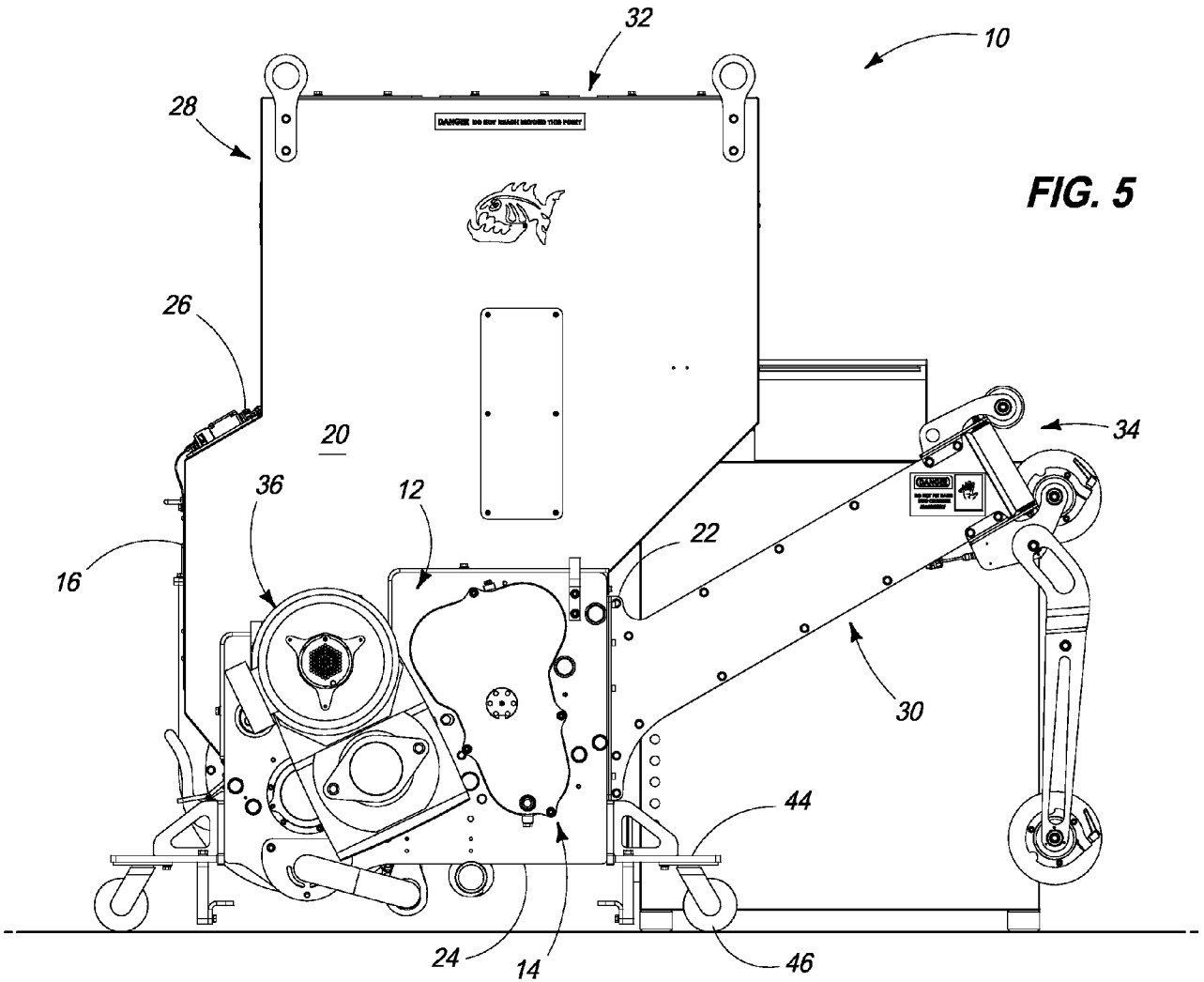
FIG. 5 is a left side view of the comminuting apparatus of FIGS. 1 and 3-4.
Figure 6:
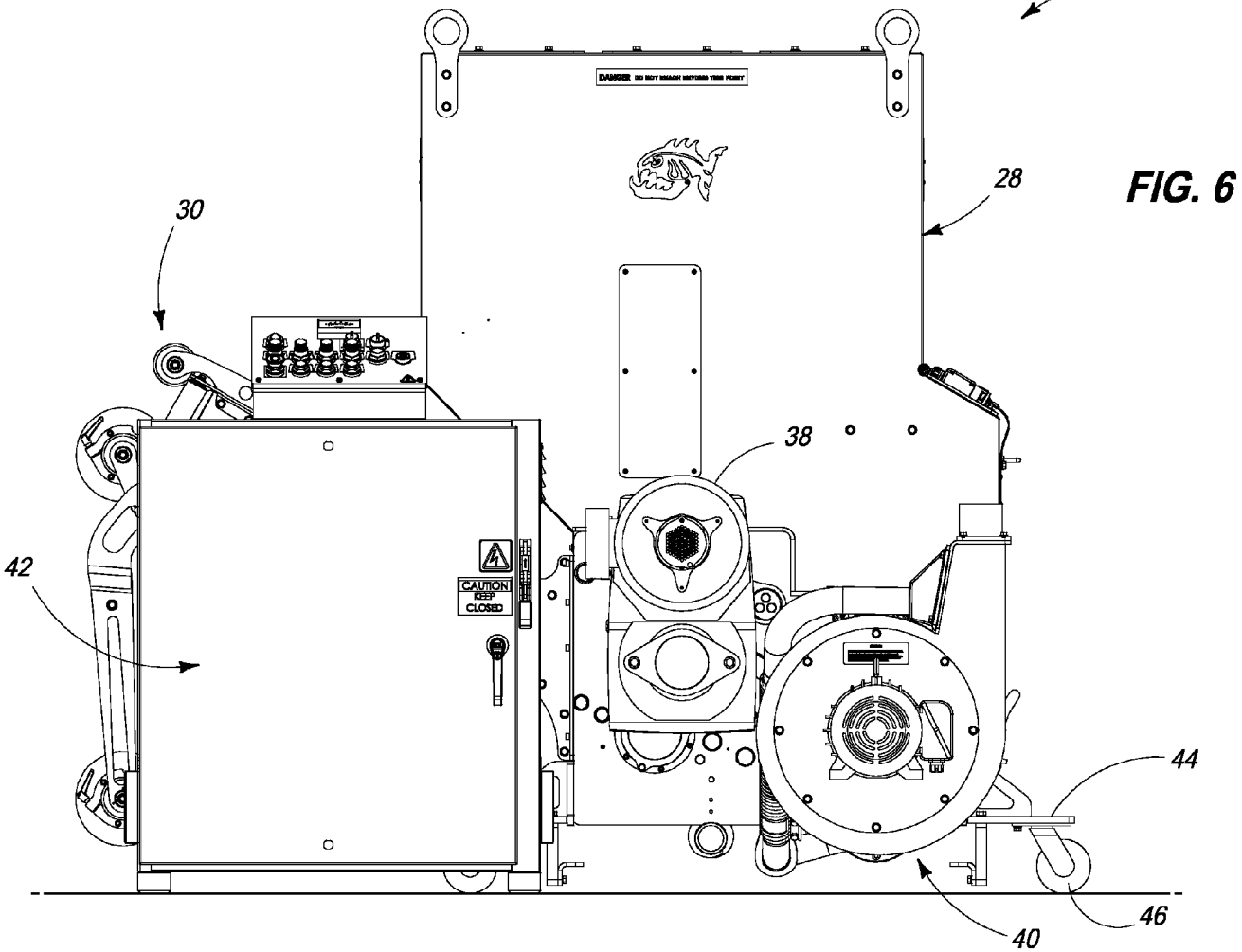
FIG. 6 is a right side view of the comminuting apparatus of FIGS. 1 and 3-5.
Figure 7:
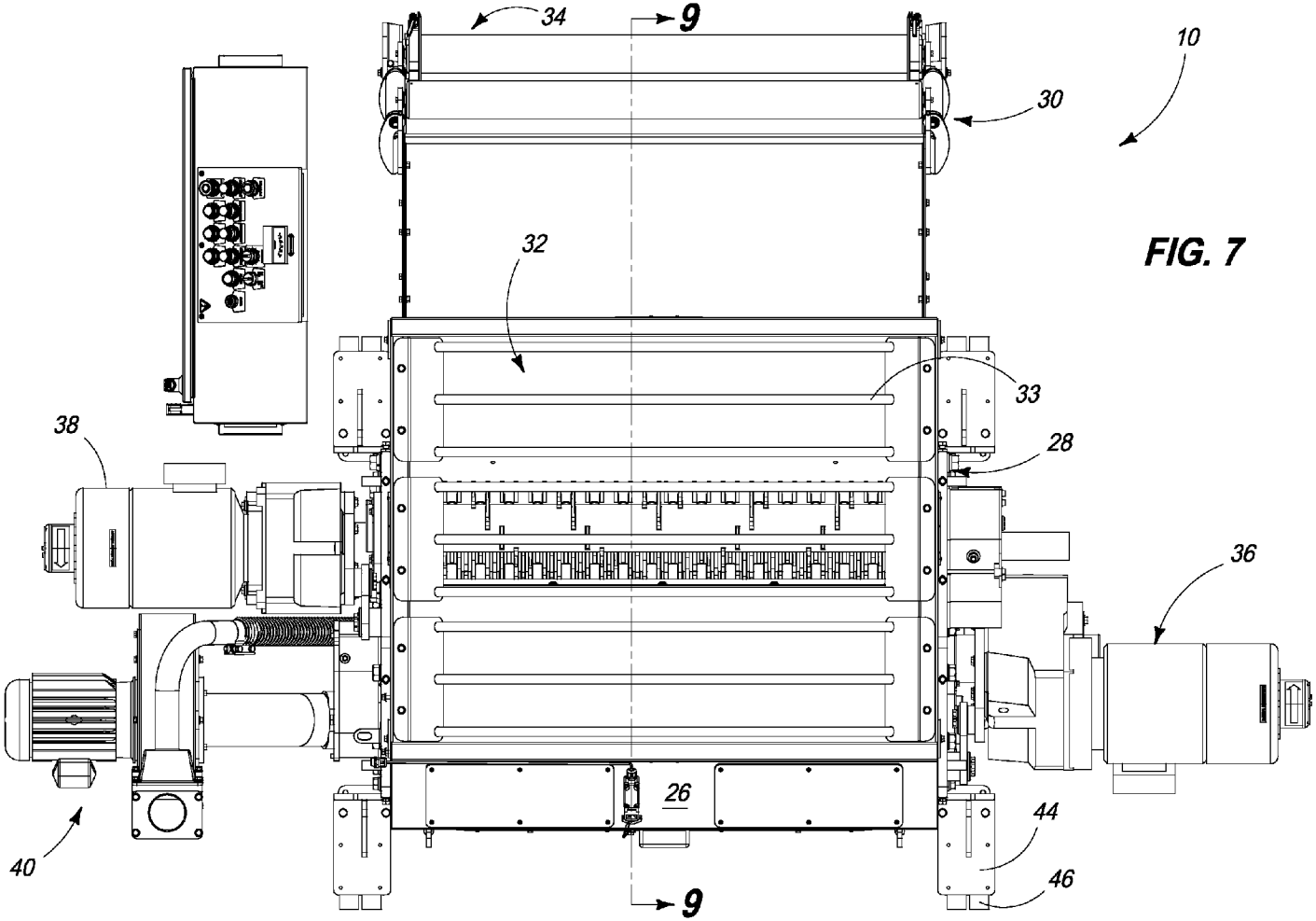
FIG. 7 is a plan view from above of the comminuting apparatus of FIGS. 1 and 3-6.
Figure 8:
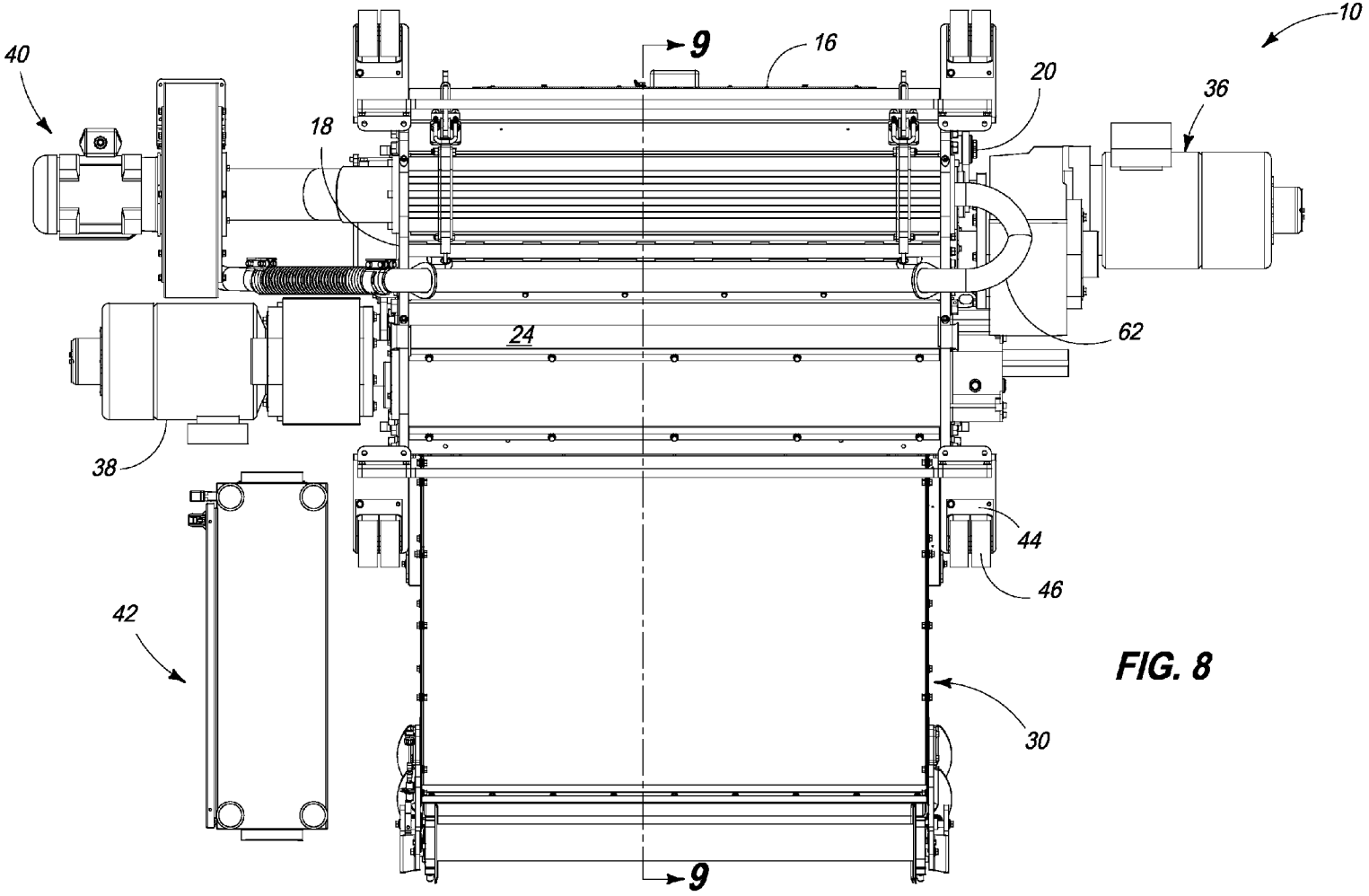
FIG. 8 is a bottom view of the comminuting apparatus of FIGS. 1 and 3-7.

FIG. 3 is back view of the comminuting apparatus 10 of FIG. 1. Drive motor assemblies 36 and 38, and pneumatic conveyor 40 extend outwardly from apparatus 10. As shown in FIG. 4, a front view of the comminuting apparatus 10 of further illustrates arrangement of drive motor assemblies 36 and 38, and pneumatic conveyor 40. As seen in FIG. 5, a left side view of the comminuting apparatus 10 further illustrates orientation of material receiving ducts 28 and 30 relative to enclosure 14. As shown in FIG. 6, a right side view of the comminuting apparatus 10 illustrates positioning of control cabinet 42, motor 38 and conveyor 40. FIG. 7 further shows in plan view from above the comminuting apparatus 10 with three guards 33 provided across material entrance 32. FIG. 8 depicts in bottom view the arrangement of motor assemblies 36 and 38, conveyor 40, and cabinet 42 of the comminuting apparatus 10.

FIG. 9 is a vertical sectional view taken along line 9-9 of FIG. 8 illustrating pair 48 of scissor rolls configured to receive scrap material from side material receiving duct 30 and from top material receiving duct 28 by way of in-feed roll 52. Subdivided waste material that has passed between pair 48 is drawn down beneath and between pair 50 where further subdivided scrap material exits over the top of one or both of scraper plate assemblies 55 and 56. Further subdivided scrap material that passes over the top of scraper plate assembly 55 then passes downwardly by the outer end, or top of scraper plate assembly 54 to be drawn beneath and between pair 50 for further subdividing of such waste material. Each time subdivided waste material passes over scraper plate assembly 56 and beneath the left-most scissor roll of pair 50, such material passes along a separator screen 65 (see FIG. 10). Sufficiently small scrap material then drops beneath screen 65 where it is drawn out via pneumatic conveyor 40 (see FIG. 8).

FIG. 10 is an enlarged partial and sectional view of the pairs 48 and 50 of scissor rolls 74-75 and 76-77 within the comminuting apparatus 10 and corresponding with the sectional view taken in FIG. 9. A pair of cross members 68 and 70 each carry a series of spaced-apart fingers, or bolts that co-act with discrete fingers on feed roll 52 while drawing in scrap material from above. Scissor roll 75 is supported between another pair of cross members 64 and 72. Cross member 64 comprises another scraper plate assembly that clears scrap material from around scissor roll 75. Finally, cross member 66 is provided adjacent scissor roll 77. Cross members 64, 66, 68, 70, and 72 are mounted at opposite ends to respective end plates of side walls 18 and 20 (see FIG. 4).

Figure 11:
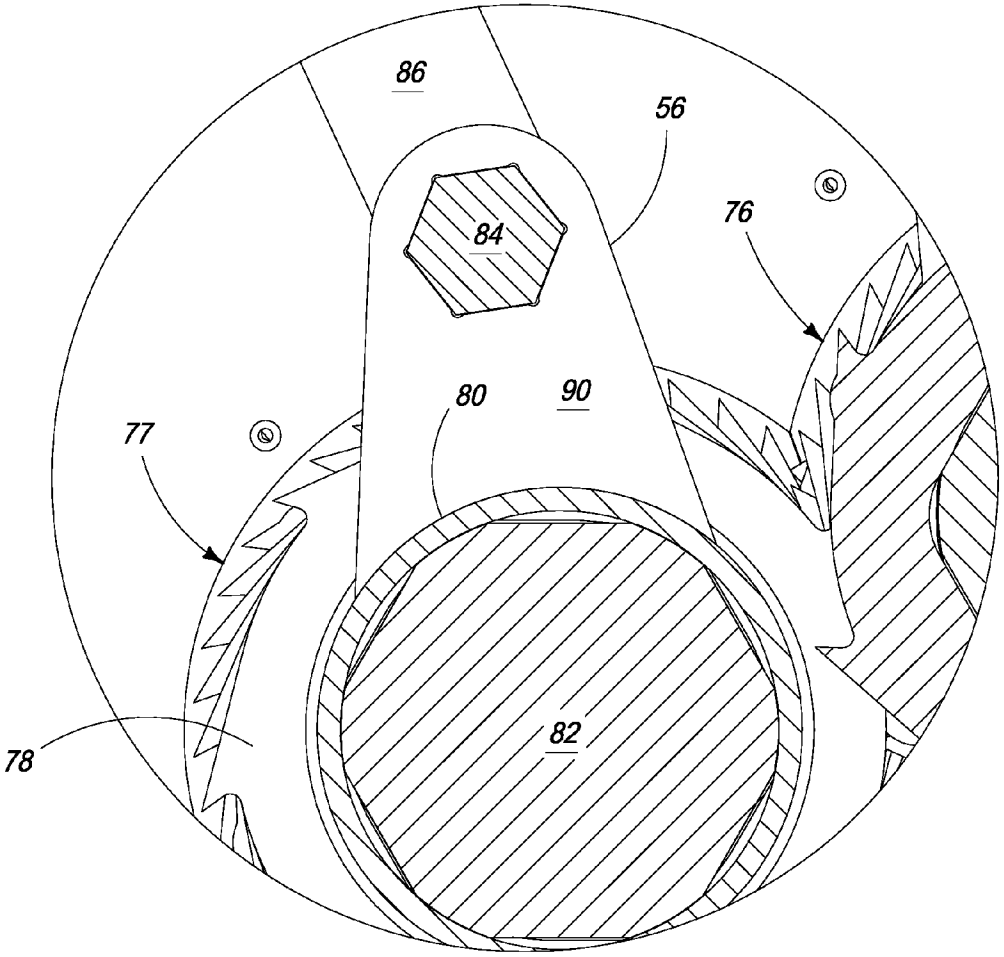
FIG. 11 is a further enlarged view of a scissor roll taken from encircled region 11 of FIG. 10.

FIG. 11 is a further enlarged view of a scissor roll 77 and scraper plate assembly 56 taken from encircled region 11 of FIG. 10. Hexagonal shaft 84 of scraper plate assembly 56 (see FIG. 10) is affixed at a far end to end mounting bracket 86 so as to prevent rotation. Bracket 86 and shaft 84 are constructed essentially the same as bracket 186 and shaft 184 (of FIG. 15). In fact, scraper plate assemblies 54-56 are each constructed in the same manner as scraper plate assembly 154 (of FIG. 15). However, the only difference is that each individual assembly in a pair is mounted 180 degrees in the opposite direction. As shown, each beak (stripper finger) 90 rings in a complementary cylindrical outer surface groove in ring 80. Each beak 90 has a complementary hexagonal aperture in beak 90 that supports beak 90 on hexagonal shaft 84 so as to prevent any rotation, as bracket 86 (and opposite end bracket) secure shaft 84 to the frame of the comminuting apparatus.

Figures 15, 16:
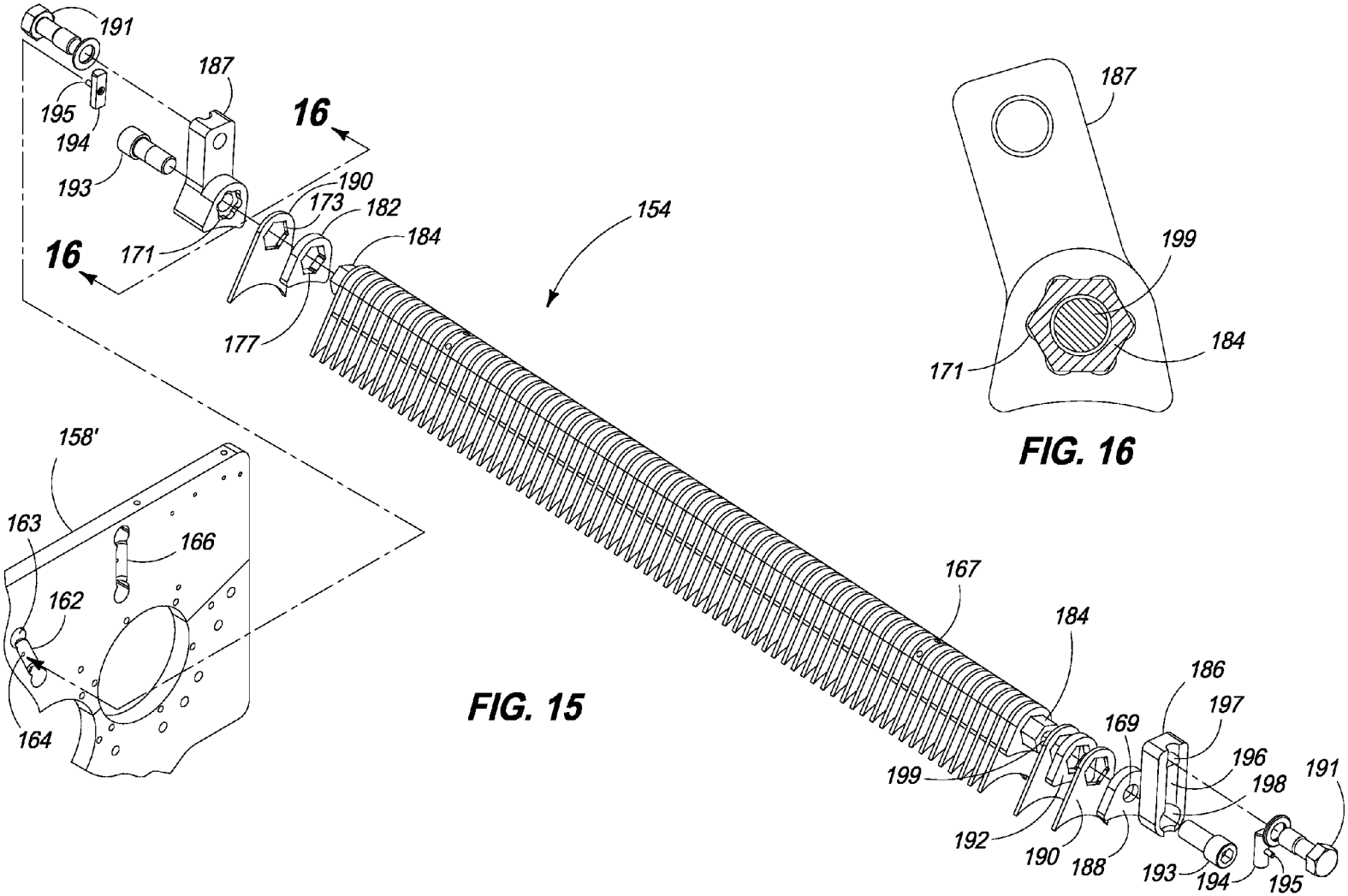
FIG. 15 is a partially exploded perspective view of a low profile scraper plate assembly of FIGS. 12-14, as well as one of the low profile scraper plate assemblies of FIG. 24.
FIG. 16 is a vertical sectional view taken along line 16-16 of FIG. 15.

FIGS. 12-14 and 22-23 illustrate an alternative construction comminuting apparatus 110 with a scraper plate assembly 154 having an improved geometry for enhancing the circulation of severed waste material around scissor roll 174. Scraper plate assembly 154 is constructed in a similar manner to scraper plates 54-56 in the embodiment of FIGS. 9-10. FIGS. 15 and 16 illustrate a modified construction for the embodiment depicted in FIGS. 12-14 and 22-23, wherein both scraper plate assemblies 154 and 155 are constructed in a similar manner (but mounted 180 degrees relative to one another), and wherein scraper plate assembly 155 replaces scraper plate 164 in the embodiment of FIG. 12. For the modified embodiment of FIGS. 17 and 24 (and FIG. 15), scraper plate 155 enables subdivided material to cascade over the top of scraper plate assembly, in a way similar to how subdivided material passes over scraper plate assembly 55 in the embodiment depicted in FIG. 9.

Figure 12:
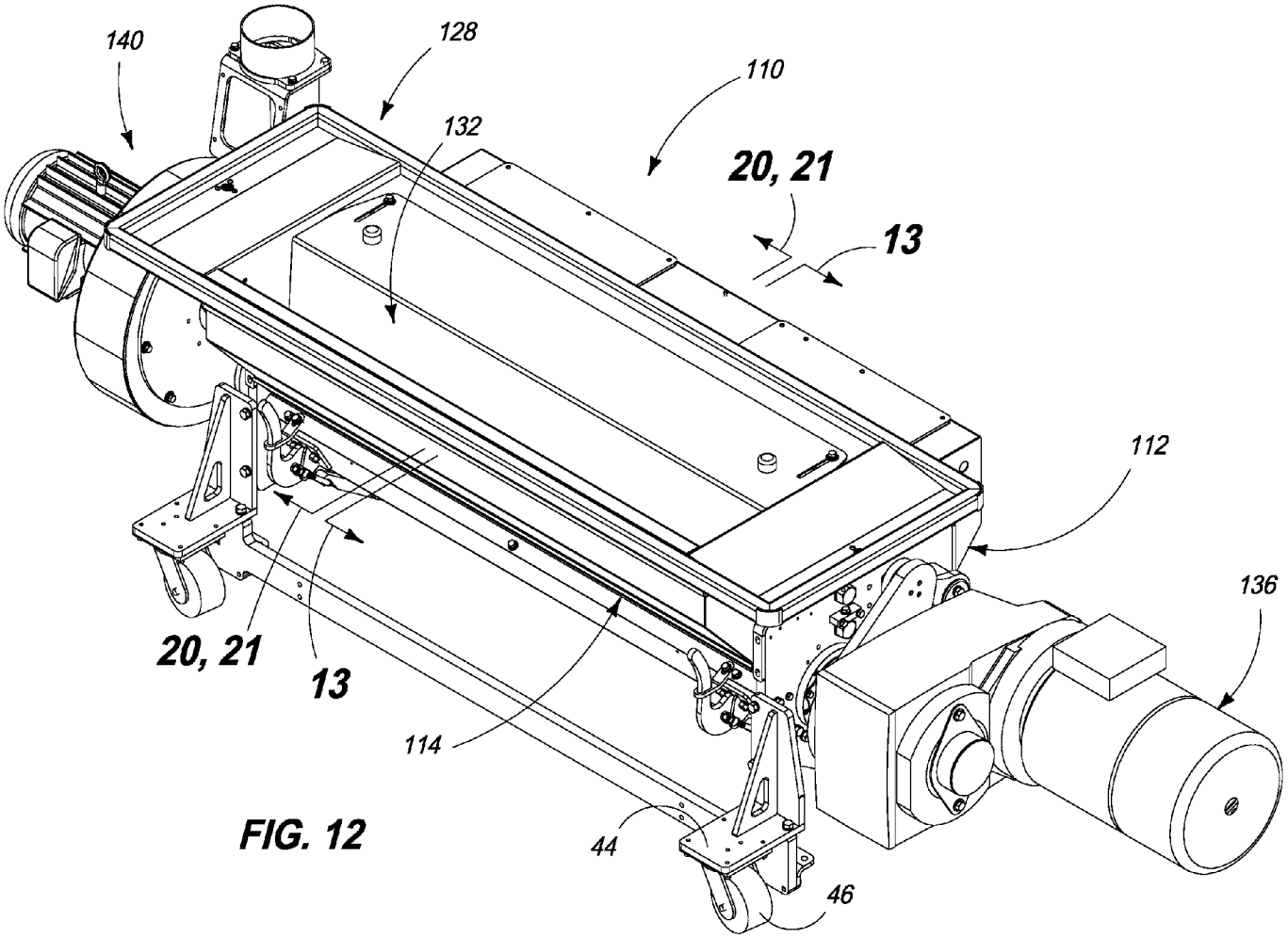
FIG. 12 is a perspective view from above of an alternative construction comminuting apparatus with a scraper plate assembly having an improved geometry for enhancing the circulation of severed waste material around scissor rolls.

As shown in FIG. 12, a material entrance 132 is provided atop material receiving duct 128 for receiving scrap material, such as thermoforming sheet scrap material. A scissor roll drive motor assembly 136 drives rolls 174 and 175 (see FIG. 13) in counter-rotation via a gear assembly. A pneumatic conveyor 140 provides a flow of air to remove sorted, small scrap material from within enclosure 114 of apparatus 110. Drive motor assembly 136 and pneumatic conveyor 140 are each mounted to frame 112 of apparatus 110. Legs 44 and pairs of wheels 46 are also mounted to frame 112 to facilitate movement of apparatus 110 during maintenance and cleaning.

Figure 13:
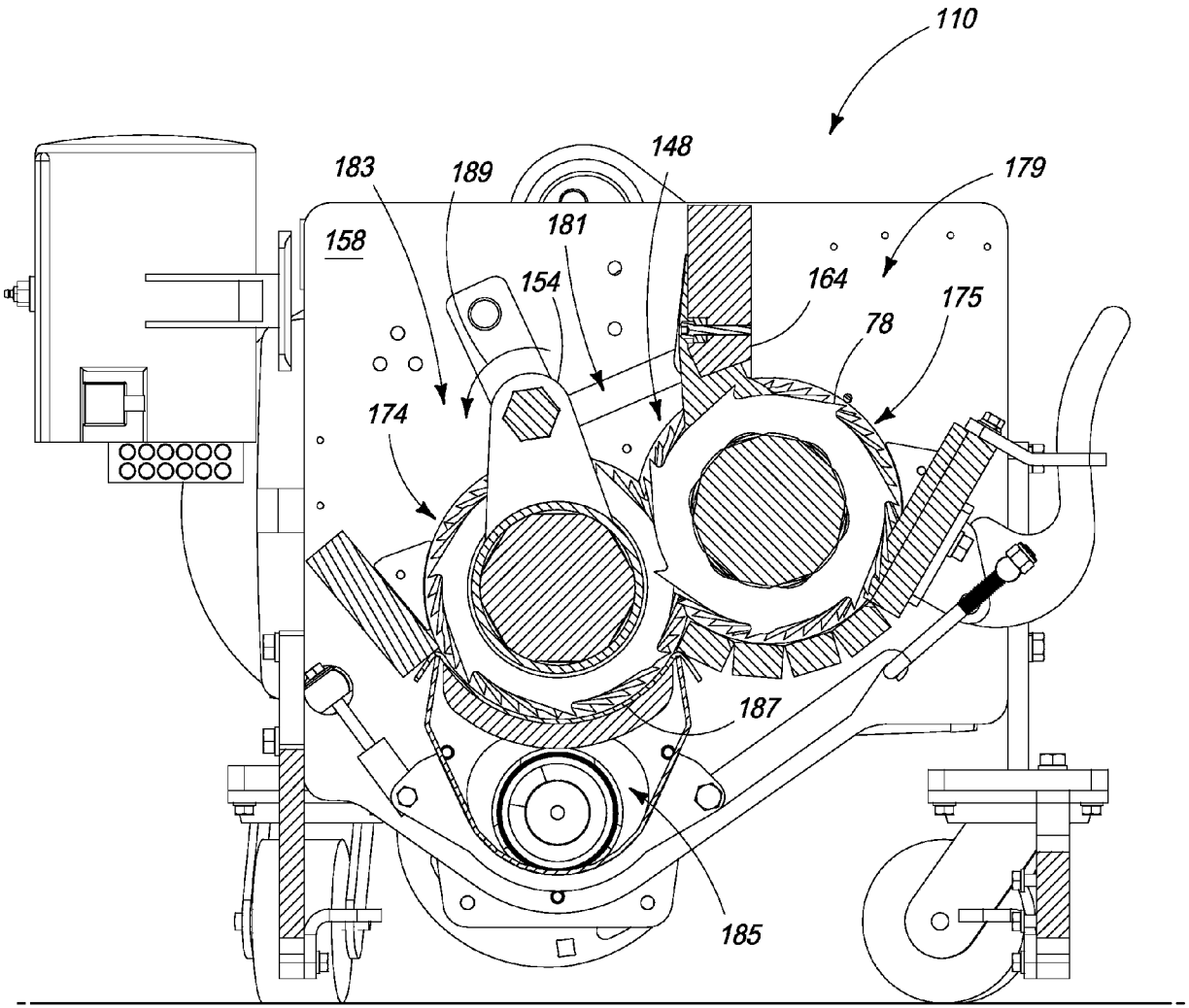
FIG. 13 is a vertical sectional view of the comminuting apparatus of FIG. 12 taken along line 13-13.

FIG. 13 is a vertical sectional view of the comminuting apparatus 110 of FIG. 12 taken along line 13-13. More particularly, scrap material (from material entrance 132 of FIG. 12) enters an intake manifold 179 where it is drawn around and beneath scissor roll 175 (by individual scissor rings 78) for subdividing between pair 148 of scissor rolls 174 and 175 for delivery up into recycle manifold 181. Subdivided scrap material then cascades over scraper plate assembly 154 for delivery into recirculation cavity, or manifold 183 via cascading flow path (or waterfall) 189. Such subdivided material is then further drawn by scissor roll 174 beneath roll 174 and screen 187 where sufficient small scrap material drops into an outtake manifold 185 for removal via airflow from pneumatic conveyor 140 (see FIG. 12). A rigid cross member mounted to end plates (such as plate 158) provides a scraper plate assembly 164. Assembly 164 (of FIG. 13) can be replaced with a scraper plate assembly similar to scraper plate assembly 154, as shown in FIG. 15, according to an optional construction.

Figure 14:
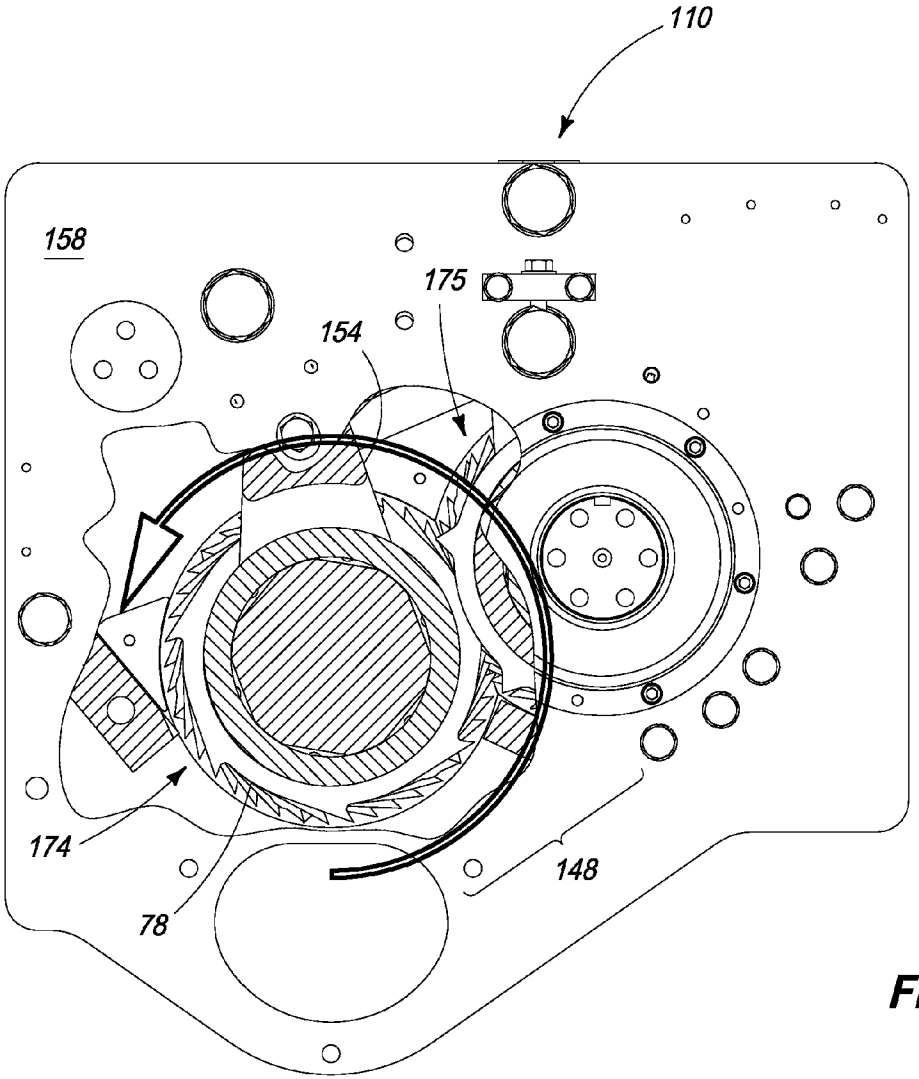
FIG. 14 is a component end view in partial vertical sectional view showing the pair of scissor rolls of FIG. 13.

FIG. 14 is a component end view in partial vertical sectional view showing the pair of scissor rolls 174 and 175 of FIG. 13. Rolls 174 and 175 of apparatus 110 rotate in counter rotation, and are geared together at one end. Scraper plate assembly 154 is shown interacting with roll 174, between adjacent scissor rings 78 of pair 148.

FIG. 15 is a partially exploded perspective view of a scraper plate assembly 154 of FIGS. 12-14. Optionally, FIG. 15 also combines with the scraper plate assembly of FIG. 17 to provide the optional construction comminuting apparatus 310 of FIG. 24. More particularly, assembly 154 of FIG. 15 includes an elongate steel hexagonal shaft 184 having a threaded bore 199 provided in each end. A threaded fastener 193 at each end secures a mounting bracket 186 and 187 at respective opposite ends, while also securing an end plate 188 at the end adjacent bracket 186. End plate 188 and bracket 187 retain a successively stacked arrangement of alternating beaks (or stripper fingers) 190 and spacer plates 192 along hexagonal shaft 184. A hexagonal, or star-shaped recess in bracket 187 fixes shaft 184 (as well as beaks 190, end plate 188, and spacer plates 192) from rotating relative to bracket 187. Bracket 187 is then fixed onto side plate 158 (or 158'), thereby preventing any rotation of beaks 190 relative to the frame of the comminuting apparatus. Stripper fingers 190 each have a complementary hexagonal bore 173 that fits about shaft 184, thereby preventing rotation. Likewise, spacer plates 192 each have a complementary hexagonal bore 177 that fits about shaft 184, thereby also preventing rotation. Each mounting bracket 186 has a spherically cut keyway slot 196 that mates with a complementarily-shaped (or cylindrical) dowel pin 194. Each dowel pin 194 is affixed to a respective side plate 158 (or 158', per optional construction) and 160 (see FIG. 13) with a threaded fastener 195 that is threaded into a threaded bore 164 in complementary slot 162 in side plate 158 (or 158'). Threaded fastener 191 is then passed through a respective bore 163 in each end plate, so as to secure scraper plate 154 within the housing or enclosure 114 (see FIG. 12). Each bore 163 is actually elliptical, enabling up and down adjustment of brackets 186 and 187 along the main axis of slots 162 to ensure precise fit-up of each beak 190 along a respective ring 180 (see FIGS. 18 and 19).

FIG. 16 is a vertical sectional view taken along line 16-16 of FIG. 15 illustrating fit-up between the hexagonal shaft 184 and the hexagonal, or star-shaped (with corner reliefs) end aperture 171 provided within end bracket 187. Such fit-up between shaft 184 and aperture 171 prevents any rotation between bracket 187 (and end plate 158, 158') and shaft 184 (and beaks 190). Such construction provides torsional rigidity that is particularly desirable when beaks 190 are subjected to scrap material movement and compaction within a comminuting apparatus. Otherwise, such beaks can be subjected to undue wear and even structural failure due to material loading and (sometimes) jamming within the comminuting apparatus. Furthermore, such jamming can create friction, which can further cause melting of scrap material, which further jams the comminuting apparatus. Optionally, provision of bore 171 in end bracket 187 can be slightly oversized in depth so as to enable a minute amount of "floating" of beaks 190 between respective scissor rings, as tightening of fasteners 193 into shaft 184 at each end does not clamp together beaks 190 and spacers 192.

Figure 17:
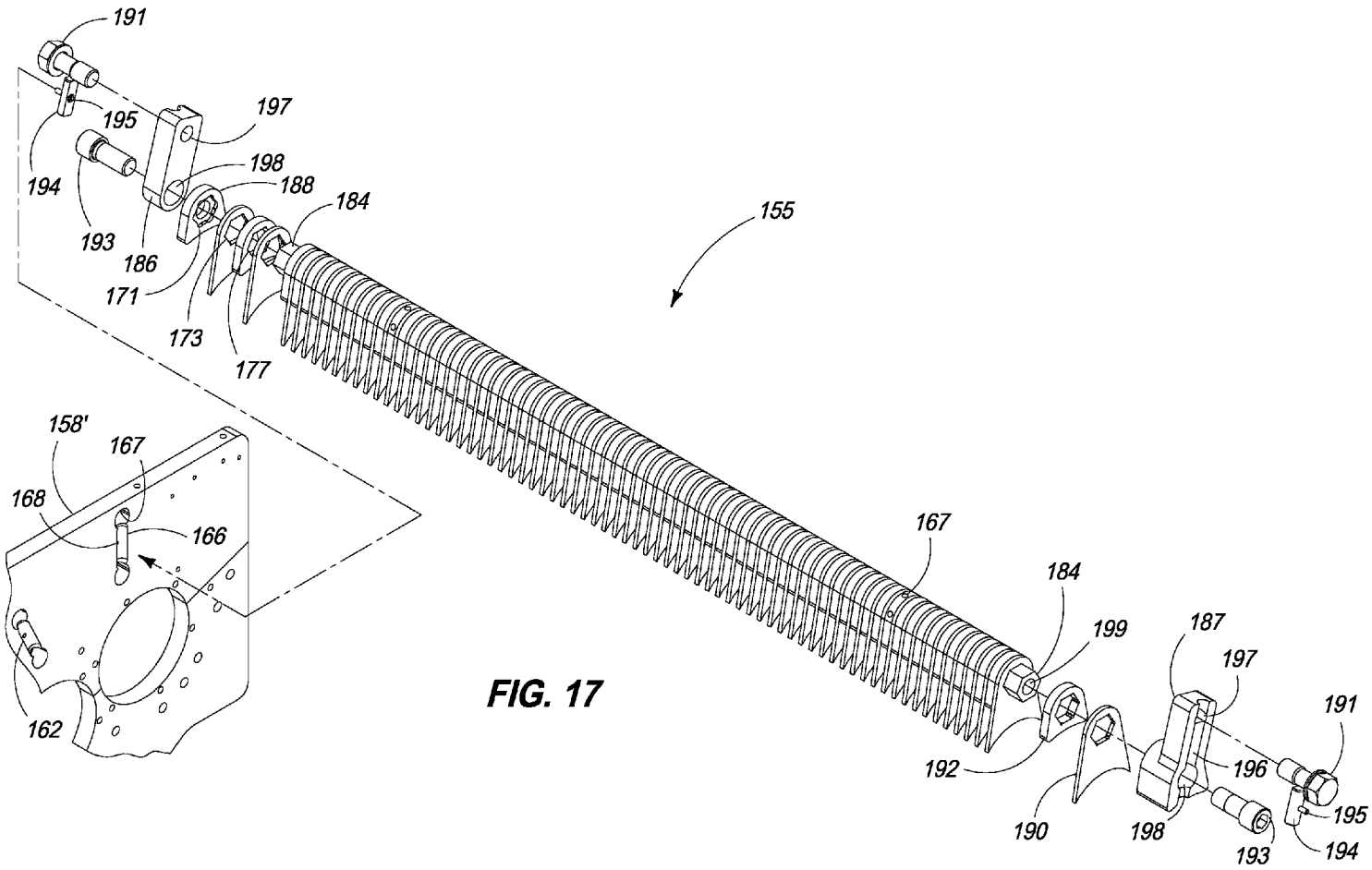
FIG. 17 is a partially exploded perspective view of another one of the scraper plate assemblies of FIG. 24.
Figure 24:
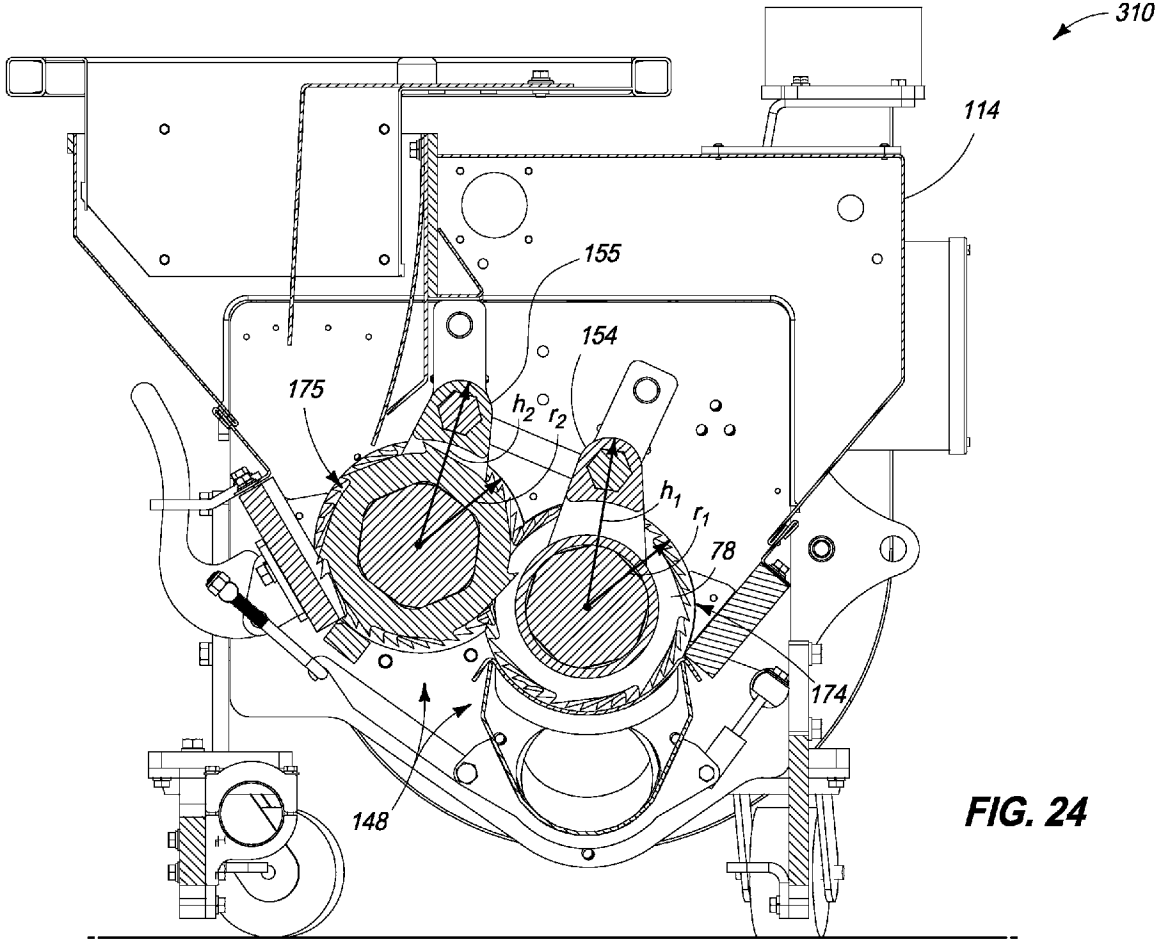
FIG. 24 is an optional construction over that depicted in FIGS. 12-13, and includes the scraper plate assemblies of FIGS. 15 and 17.

FIG. 17 is a partially exploded perspective view of another one of the scraper plate assemblies of FIG. 24, namely scraper plate assembly 155. Scraper plate assembly 155 is identical to scraper plate assembly 154, but is mounted in a reverse (or 180 degree rotated) direction relative to assembly 154. In the optional construction of FIG. 24, scraper plate assembly 155 replaces scraper plate 164 (of FIG. 13). Accordingly, end bracket 187 is provided at an opposite end (than for assembly 154), and end bracket 186 is also provided at an opposite end (than for assembly 154). Scraper plate assembly 155 is mounted by receiving dowel pins 194 into slot 166, and engaging threaded fastener 195 into threaded bore 168. Threaded bolt 191 is then received through elongated bore (or slot) 167 (from the outside) and threaded into threaded bore 197 (in brackets 186 and 187, respectively). Fasteners 193 are threaded into threaded bores 199 in each end of rod 184 so as to secure beaks 190, spacers 192 and end plate (or spacer) 188 together.

Figure 18:
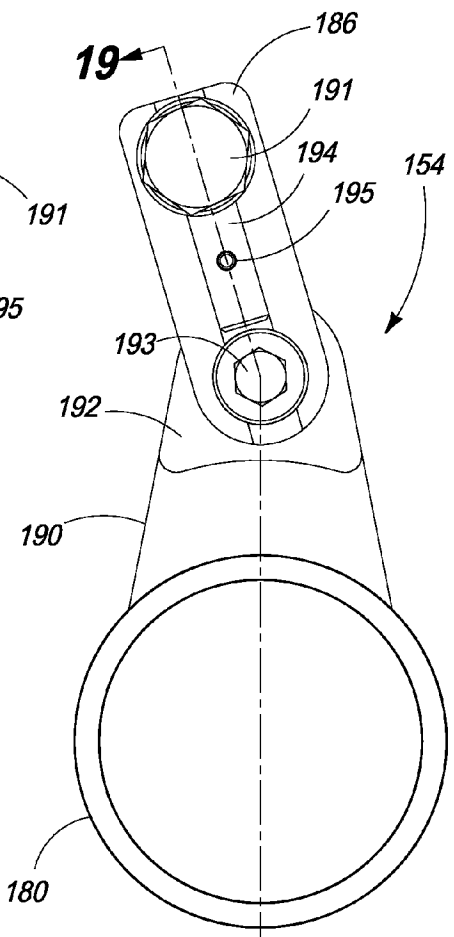
FIG. 18 is a component vertical sectional view depicting interaction between a stripper finger, or beak and an associated ring.

FIG. 18 is a component vertical sectional view depicting interaction between a selected stripper finger, or beak 190 and an associated ring 180 having an inwardly extending, complementary groove in the radial-outer surface for receiving the beak 190.

Figure 19:
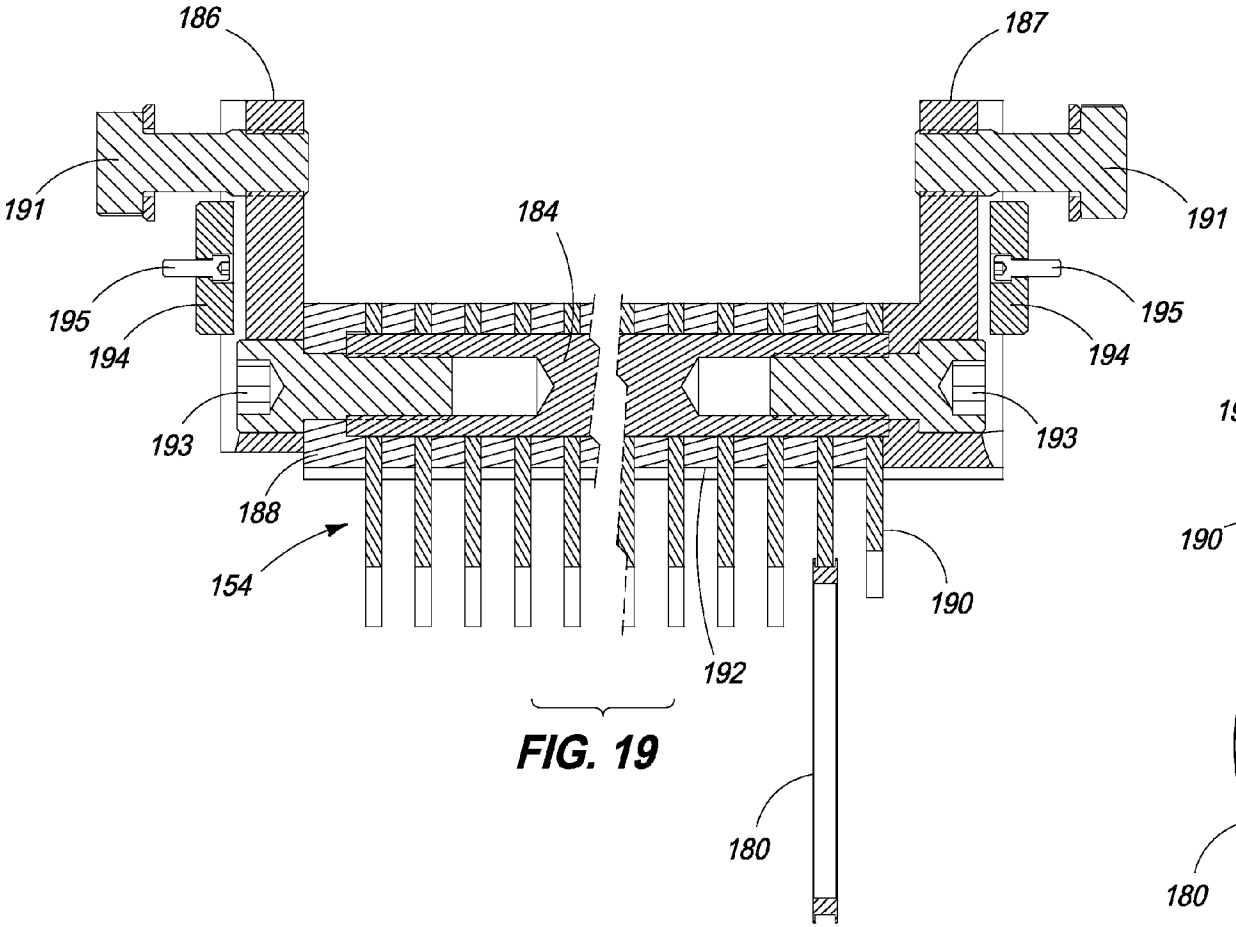
FIG. 19 is a vertical sectional component view taken along line 19-19 of FIG. 18 and depicting interaction of a grooved ring with a single stripper finger, or beak.

FIG. 19 is a vertical sectional component view taken along line 19-19 of FIG. 18 and depicting interaction of grooved ring 180 with a single stripper finger, or beak 190. Furthermore, the alternating assembly of adjacent beaks 190 and spacers 192 is clearly shown. Threaded fasteners 195 are each received within a threaded bore 164 of plate 158 or 158' (see FIG. 15).

Figure 20:
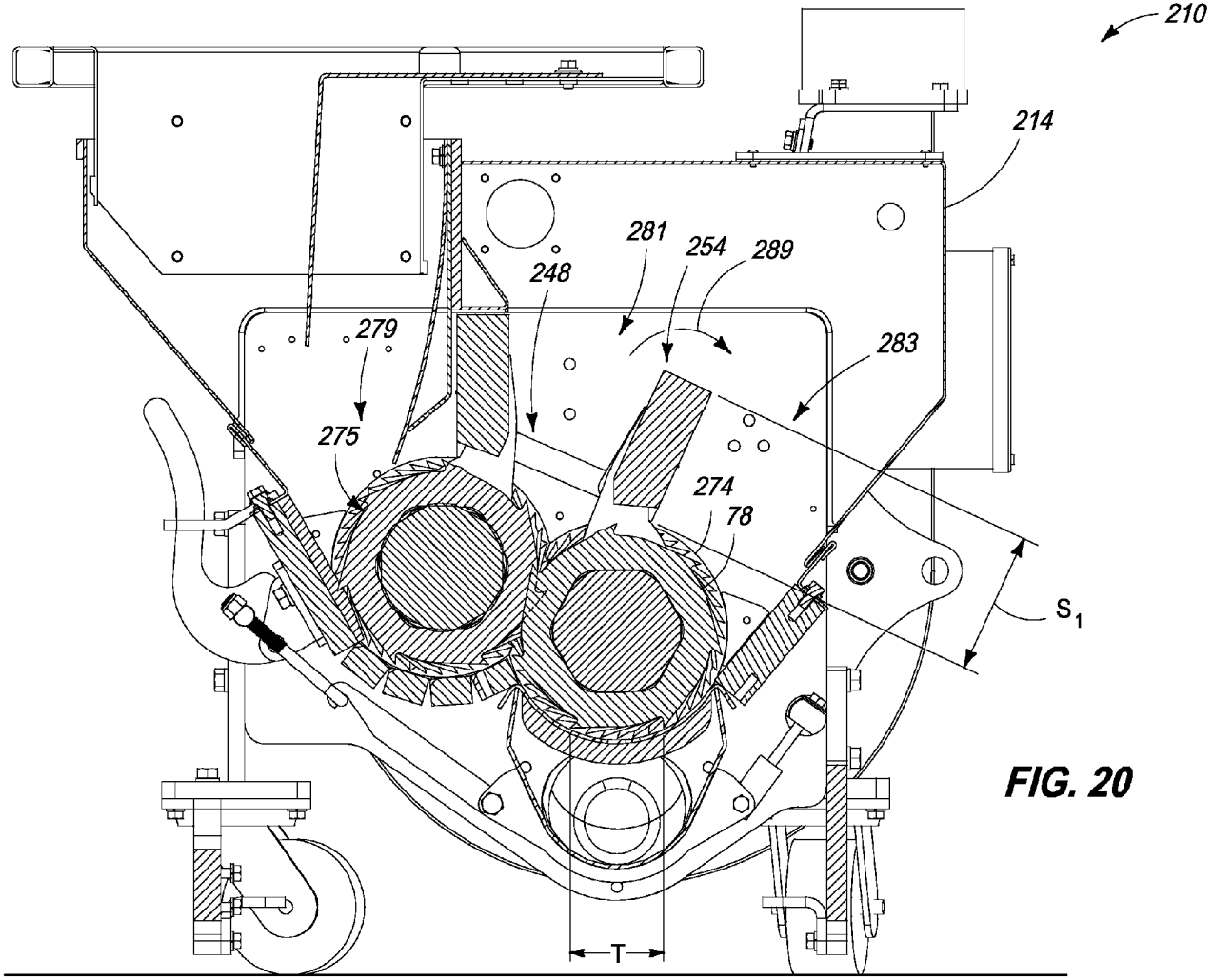
FIG. 20 is a vertical sectional view of an alternatively constructed comminuting apparatus having a less preferred scraper plate assembly having a tendency to clog with subdivided waste material under certain operating conditions.

FIG. 20 is a vertical sectional view of an alternatively constructed comminuting apparatus 210 having a less preferred scraper plate assembly 254 with sharp top corners, vertical sides, and higher top elevation, and having a tendency to clog with subdivided waste material under certain operating conditions. More particularly, scraper plate 254 has radially outwardly extending height (measured from the central axis of roll 274) of nearly 10 inches, whereas roll 274 has a radius (to the outermost cutting tip) of 3.972 inches, according to one construction. Dimension "S1" exceeds the radius of roll 274, which inhibits the ability of subdivided scrap material (that mats up inside of comminuting apparatus 210) to be drawn downwardly by rings 78 beneath roll 274 for further subdividing. Hence, the elevation of scraper plate assembly 254 can lead to jamming of subdivided scrap material within apparatus 210, as shown below with reference to FIG. 21.

FIG. 21 is a vertical sectional view of the alternatively constructed comminuting apparatus 210 of FIG. 20 showing a clog of subdivided waste material within the enclosure 214. Dimension "D1" is less than dimension "S1", shown in FIG. 20. By reducing the height of the scraper plate assembly (using scraper plate assembly 154 of FIG. 22), dimension "D1" becomes a nullity, and scrap material is drawn by scissor rings 78 of roll 154 for further subdividing, according to the embodiment of FIG. 22.

Figure 22:
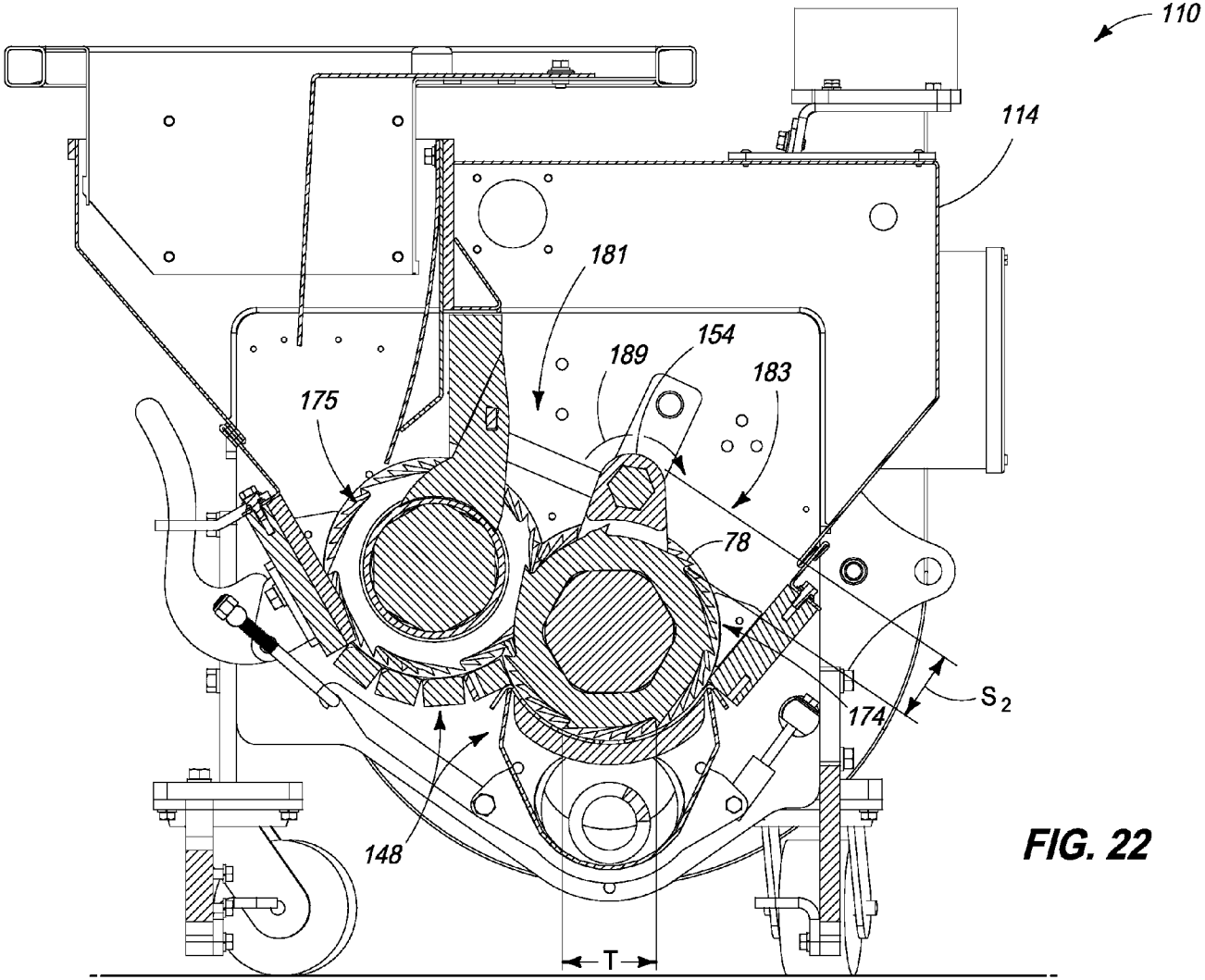
FIG. 22 is a vertical sectional view of the comminuting apparatus 110 of FIGS. 12-20 with a preferred scraper plate assembly having a tendency to minimize or eliminate clogging of subdivided waste material.

FIG. 22 is a vertical sectional view of the comminuting apparatus 110 of FIGS. 12-16 and 18-19 with one embodiment scraper plate assembly 154 having a tendency to minimize or eliminate clogging of subdivided waste material. More particularly, the angled side faces of scraper plate assembly 154 combine with the reduced height end, and the rounded end to encourage flow of subdivided scrap material over waterfall path 154 for further passage around and beneath roll 174 for further subdividing between rolls 174 and 175 and sorting between roll 174 and the sorting screen.

Figure 23:
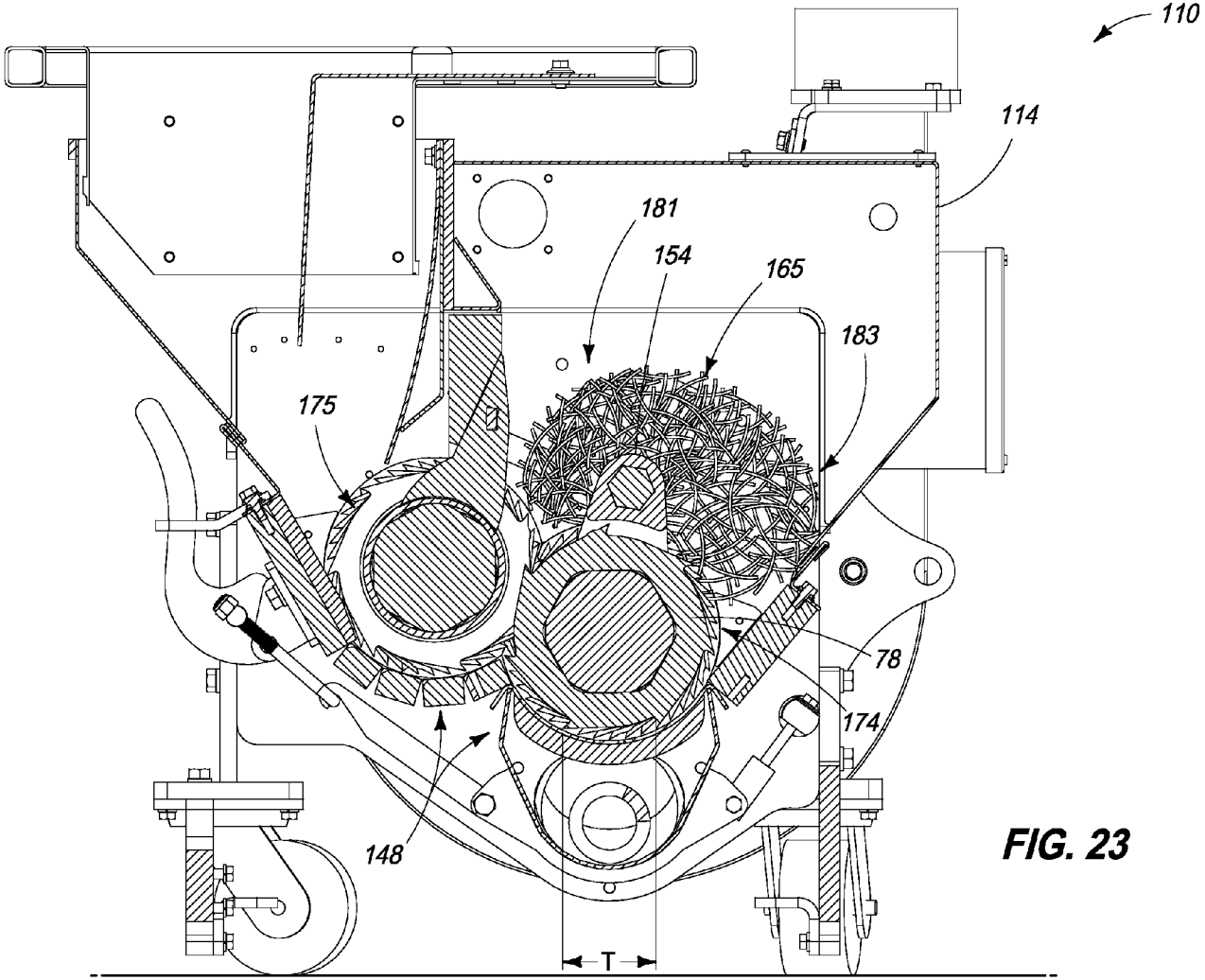
FIG. 23 is a vertical sectional view of the comminuting apparatus of FIGS. 12-20 and 22, depicting the movement of subdivided waste material being circulated or recirculated within the enclosure in a manner that reduces or eliminates clogging.

FIG. 23 is a vertical sectional view of the comminuting apparatus 110 of FIGS. 12-20 and 22, depicting the movement of subdivided waste material 154 being circulated or recirculated within the enclosure 114 in a manner that reduces or eliminates clogging. As shown in FIGS. 22-24, roll 174 has a radius (to the outermost cutting tip) of 3.972 inches and the outermost tip of scraper plate assembly 154 has a distance (from the center of roll 174) of 6.605 inches. In contrast, the distance for scraper plate assembly 254 is nearly 10 inches, which contributes to clogging of scrap material. It has been found that the combination of sloped side surfaces, rounded end, and relatively low profile on scraper plate assembly 154 facilitates flow of subdivided scrap material through comminuting apparatus 110.

FIG. 24 is vertical sectional view of a further alternative construction comminuting apparatus 310 over apparatus 110 (depicted in FIGS. 12-13 and 22 and 23). According to such construction, scraper plate assemblies 154 and 155 from FIGS. 15 and 17, respectively, are utilized to reduce scrap material clearance over each scraper plate assembly 154 and 155. According to one construction, $r_1=r_2=3.972$ inches. Also according to such one construction, $h_1=h_2=6.605$ inches. Such configuration provides a substantially reduced clearance profile for each scraper plate assembly over that depicted for the embodiment of FIGS. 20 and 21. Optional dimensions can be used as long as a similar "lower-profile" is realized for a scraper plate assembly relative to a certain sized scissor roll (and scissor ring), one that does not realize clogging and matting of subdivided scrap material.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. An apparatus for circulating comminuted materials, comprising:

a frame;

a pair of scissor rolls carried for counter-rotation by the frame defining an exit manifold therebetween;

a scraper plate inter-nested with one of the scissor rolls and having a rounded outermost end provided elevationally above the pair of scissor rolls, a pair of opposed side walls extending in converging relation to the rounded outermost end, an inner one of the side walls provided proximate the exit manifold extending upwardly and outwardly from the exit manifold sloped relative to a vertical direction, and a profile height extending beyond an outer surface of the scissor roll a distance less than a diameter of the scissor roll.

2. The apparatus of claim 1, wherein the rounded outermost end of the scraper plate transitions smoothly from at least one of the pair of opposed side walls.

3. The apparatus of claim 1, wherein an inner one of the pair of side walls transitions smoothly from the rounded outermost end.

4. The apparatus of claim 1, wherein an outer one of the pair of side walls transitions smoothly from the rounded outermost end.

5. The apparatus of claim 1, wherein the pair of scissor rolls each has a horizontal axis of rotation, and a first scissor roll of the pair of scissor rolls is provided elevated relative to a second scissor roll of the pair of scissor rolls.

6. The apparatus of claim 1, wherein an outer one of the side walls is provided distally of the exit manifold and is sloped relative to a vertical direction.

7. The apparatus of claim 1, wherein the scraper plate comprises a nested stack of stripper fingers mounted over a hexagonal shaft.

8. The apparatus of claim 1, wherein at least one of the angled side walls comprises an angled side face.

9. The apparatus of claim 1, wherein at least one of the angled side walls comprises a sloped side surface.

10. The apparatus of claim 1, wherein the rounded outermost end of the scraper plate is interposed in a smoothly transitioning surface relation with each of the adjacent side walls.

11. A comminuting apparatus, comprising:

a frame having an enclosure with an entrance for receiving solid waste material, an entrance manifold, and a recycle manifold;

a pair of overlapping scissor rolls carried for counter-rotation by the frame defining an exit manifold therebetween; and a scraper plate carried by the frame and inter-nested with one of the scissor rolls and having a rounded outermost end provided elevationally above at least one of the pair of scissor rolls, a pair of opposed side walls extending in converging relation to the rounded outermost end, an inner one of the side walls provided proximate the exit manifold extending upwardly and outwardly from the exit manifold sloped relative to a vertical direction, and a profile outermost dimension extending in a radially outward direction from an outermost surface of the one scissor roll through a center axis of the one scissor roll less than a diameter of the scissor roll, the scraper plate communicating with at least one of the recirculation manifold and the recycle manifold to enable subdivided scrap material to cascade over the outermost end and into one of the recirculation manifold and the recycle manifold.

12. The apparatus of claim 11, wherein the rounded outermost end of the scraper plate is interposed in smoothly transitioning relation with one of the pair of opposed side walls.

13. The apparatus of claim 12, wherein an inner one of the pair of side walls transitions smoothly from the rounded outermost end.

14. The apparatus of claim 12, wherein an outer one of the pair of side walls transitions smoothly from the rounded outermost end.

15. The apparatus of claim 12, wherein the rounded outermost end of the scraper plate is interposed in smoothly transitioning relation with both of the pair of opposed side walls.

16. The apparatus of claim 11, wherein the pair of scissor rolls each has a horizontal axis of rotation, and a first scissor roll of the pair of scissor rolls is provided elevated relative to a second scissor roll of the pair of scissor rolls.

17. The apparatus of claim 11, wherein an outer one of the side walls is provided distally of the exit manifold and is sloped relative to a vertical direction.

18. The apparatus of claim 11, wherein the scraper plate comprises a nested stack of stripper fingers mounted over a hexagonal shaft.

19. The apparatus of claim 11, wherein the exit manifold extends in a generally upward direction.

20. The apparatus of claim 11, wherein the exit manifold extends in a generally downward direction.

* * * * *